US011719209B2

(12) United States Patent
Gosavi et al.

(10) Patent No.: US 11,719,209 B2
(45) Date of Patent: Aug. 8, 2023

(54) INTEGRATED STARTER-GENERATOR DEVICE WITH UNIDIRECTIONAL CLUTCH ACTUATION UTILIZING BIASED LEVER ASSEMBLY

(71) Applicant: Deere & Company, Moline, IL (US)

(72) Inventors: Yuvraj B. Gosavi, Pune (IN); K. M. Vignesh, Pune (IN); Jeffrey S. Turner, Coffeyville, KS (US); Lisa R. Lloyd, Independence, KS (US)

(73) Assignee: DEERE & COMPANY, Moline, IL (US)

( * ) Notice: Subject to any disclaimer, the term of this patent is extended or adjusted under 35 U.S.C. 154(b) by 144 days.

(21) Appl. No.: 17/216,243

(22) Filed: Mar. 29, 2021

(65) Prior Publication Data

US 2022/0307455 A1 Sep. 29, 2022

(51) Int. Cl.

| | |
|---|---|
| ***F02N 11/04*** | (2006.01) |
| ***F02N 15/06*** | (2006.01) |
| ***F02N 15/02*** | (2006.01) |
| *F02N 15/04* | (2006.01) |

(52) U.S. Cl.

CPC ..... *F02N 11/04* (2013.01); *F02N 15/022* (2013.01); *F02N 15/063* (2013.01); *F02N 15/046* (2013.01)

(58) Field of Classification Search

CPC ..... F02N 11/04; F02N 15/022; F02N 15/046; F02N 15/063

See application file for complete search history.

(56) References Cited

U.S. PATENT DOCUMENTS

| | | | |
|---|---|---|---|
| 1,625,564 | A | 4/1927 | Pollard |
| 2,685,948 | A | 8/1954 | Freeman et al. |
| 3,062,073 | A | 11/1962 | Brass |

(Continued)

FOREIGN PATENT DOCUMENTS

| | | | |
|---|---|---|---|
| CN | 106763565 | A | 5/2017 |
| DE | 2619011 | A1 | 12/1981 |

(Continued)

OTHER PUBLICATIONS

German Search Report issued in German Application No. 102021113924.4 dated Sep. 30, 2021. (7 pages).

(Continued)

*Primary Examiner* — John M Zaleskas

(74) *Attorney, Agent, or Firm* — Klintworth & Rozenblat IP LLP

(57) ABSTRACT

A starter-generator device for a work vehicle having an engine includes a gear set for transmitting power, one or more clutch portions configured to selectively interact with the gear set, an actuator device to power movement of an armature only in a first direction, and a linkage having a first portion extending axially and having a neck region formed as a permanent bend and having a bend radius. The linkage also includes a second portion extending radially from the first portion to a distal end. An actuation pin is connected to the distal end and to the clutch portion such that movement of distal end causes corresponding movement of the clutch portion. Powered movement of the armature moves the distal end in one direction. An elastic return force of the linkage moves the distal end in an opposite direction.

19 Claims, 24 Drawing Sheets

(56) References Cited

U.S. PATENT DOCUMENTS 3,081,759 A 3/1963 Mauck et al.
3,150,544 A 9/1964 Brass
3,640,152 A 2/1972 Shirai et al.
3,675,511 A 7/1972 Wakamatsu et al.
3,942,024 A 3/1976 Ingham
4,122,354 A 10/1978 Howland
4,213,299 A 7/1980 Sharar
4,473,752 A 9/1984 Cronin
4,484,495 A 11/1984 Mason
4,569,252 A 2/1986 Harper
4,631,455 A 12/1986 Taishoff
4,708,030 A 11/1987 Cordner
4,750,384 A 6/1988 Belliveau
4,862,009 A 8/1989 King
4,916,980 A 4/1990 Asada et al.
4,926,713 A 5/1990 Madill
5,033,994 A 7/1991 Wu
5,177,968 A 1/1993 Fellows
5,418,400 A 5/1995 Stockton
5,558,173 A 9/1996 Sherman
5,856,709 A 1/1999 Ibaraki et al.
5,993,354 A 11/1999 Winks
6,015,363 A 1/2000 Mathis
6,371,877 B1 4/2002 Schroeder et al.
6,378,479 B1 4/2002 Nishidate et al.
RE37,743 E 6/2002 Yang
6,409,622 B1 6/2002 Bolz et al.
6,484,596 B2 11/2002 Puchas
6,527,658 B2 3/2003 Holmes et al.
6,569,054 B2 5/2003 Kato
6,582,333 B2 6/2003 Man
6,661,109 B2 12/2003 Fukasaku et al.
6,746,354 B1 6/2004 Ziemer
6,770,005 B2 8/2004 Aikawa et al.
6,811,010 B1 11/2004 Armstrong
6,832,970 B2 12/2004 Eibler
6,852,063 B2 2/2005 Takahashi et al.
6,910,453 B2 6/2005 Sugino et al.
6,965,173 B2 11/2005 Fukasaku et al.
7,028,794 B2 4/2006 Odahara et al.
7,044,255 B2 5/2006 Maeda et al.
7,086,978 B2 8/2006 Aikawa et al.
7,117,965 B2 10/2006 Yatabe et al.
7,223,191 B2 5/2007 Aikawa et al.
7,374,031 B2 5/2008 Skorucak
7,387,043 B2 6/2008 Sakamoto et al.
7,503,871 B2 3/2009 Kozarekar et al.
7,582,033 B2 9/2009 Kefti-Cherif et al.
7,753,147 B2 7/2010 Usoro
7,780,562 B2 8/2010 King et al.
8,143,735 B2 3/2012 Bauer
8,226,517 B2 7/2012 Tsai et al.
8,235,859 B2 8/2012 Yun
8,480,529 B2 7/2013 Pohl et al.
8,500,601 B2 8/2013 Arnold et al.
8,584,359 B1 11/2013 Bowman
8,727,944 B2 5/2014 Noboru et al.
8,734,281 B2 5/2014 Ai et al.
8,996,227 B2 3/2015 Sisk et al.
9,017,207 B2 4/2015 Pohl et al.
9,074,656 B2 7/2015 Benz et al.
9,145,136 B2 9/2015 Suntharalingam et al.
9,184,646 B2 11/2015 Fulton
9,261,064 B2 2/2016 Patel et al.
9,371,810 B2 6/2016 Revision
9,421,855 B2 8/2016 Suntharalingam et al.
9,541,172 B1 1/2017 Wright
9,555,795 B2 1/2017 Nefcy et al.
9,676,265 B2 6/2017 Choi
9,726,282 B2 8/2017 Pohl et al.
9,829,103 B2 11/2017 Volpert
9,862,260 B2 1/2018 Lee
10,167,906 B2 1/2019 Neelakantan et al.
10,183,569 B2 1/2019 Toyota et al.
10,422,389 B2 9/2019 Ebihara
10,479,187 B2 11/2019 Lubben et al.
10,487,918 B2 11/2019 Turner et al.
10,518,626 B2 12/2019 Pettersson
10,519,920 B2 12/2019 Patil et al.
10,591,025 B2 3/2020 Fliearman et al.
10,619,711 B2 4/2020 Fliearman et al.
10,900,454 B1 * 1/2021 Fliearman ..... H02K 7/1085
2001/0019210 A1 9/2001 Fukasaku et al.
2001/0025621 A1 10/2001 Shiraishi et al.
2001/0042649 A1 11/2001 Maeda et al.
2002/0019284 A1 2/2002 Aikawa et al.
2002/0033059 A1 3/2002 Pels
2002/0117860 A1 8/2002 Man et al.
2002/0139592 A1 10/2002 Fukasaku et al.
2002/0177504 A1 11/2002 Pels
2003/0001391 A1 1/2003 Kuang et al.
2003/0104900 A1 6/2003 Takahashi
2003/0224888 A1 12/2003 Wilder et al.
2004/0055800 A1 3/2004 Katou et al.
2004/0116226 A1 6/2004 Baker et al.
2006/0111211 A1 5/2006 Kefti-Cherif et al.
2006/0154771 A1 7/2006 Klemen et al.
2006/0166777 A1 7/2006 Aikawa et al.
2007/0108006 A1 5/2007 Schmid et al.
2007/0157899 A1 7/2007 Seufert et al.
2007/0265126 A1 11/2007 Janson et al.
2008/0162007 A1 * 7/2008 Ishii ..... F02N 11/0855
290/38 R
2008/0179119 A1 7/2008 Grenn et al.
2008/0179159 A1 7/2008 Pollman
2008/0314195 A1 12/2008 Andoh et al.
2009/0055061 A1 * 2/2009 Zhu ..... F16H 47/04
903/910
2009/0176611 A1 7/2009 Avery
2009/0264241 A1 10/2009 Dittrich et al.
2009/0312145 A1 12/2009 Pohl et al.
2010/0029428 A1 2/2010 Abe et al.
2010/0044183 A1 2/2010 Guggolz et al.
2010/0048338 A1 2/2010 Si
2010/0063704 A1 3/2010 Okubo et al.
2010/0076634 A1 3/2010 Brigham
2010/0190602 A1 7/2010 Wittkopp et al.
2010/0234166 A1 9/2010 Samie et al.
2011/0010031 A1 1/2011 Syed et al.
2011/0015020 A1 1/2011 Grosser
2011/0053729 A1 3/2011 Parsons et al.
2011/0070999 A1 3/2011 Soliman et al.
2011/0152026 A1 6/2011 Williams
2011/0263379 A1 10/2011 Liang et al.
2012/0103293 A1 5/2012 Robinette et al.
2012/0165156 A1 6/2012 Oguri
2012/0235473 A1 9/2012 Jiang et al.
2012/0240723 A1 9/2012 Gluckler et al.
2012/0316026 A1 12/2012 Oguri et al.
2013/0046427 A1 2/2013 Hohenberg
2013/0252773 A1 9/2013 Suntharalingam et al.
2013/0316873 A1 11/2013 Jansen et al.
2014/0011619 A1 1/2014 Pohl et al.
2014/0128205 A1 5/2014 Phillips et al.
2014/0137824 A1 5/2014 Jacques et al.
2014/0150604 A1 6/2014 Kaltenbach
2014/0256490 A1 9/2014 Honda
2015/0143936 A1 5/2015 Eo et al.
2015/0226323 A1 8/2015 Pohl et al.
2015/0239335 A1 8/2015 Wachter et al.
2016/0031438 A1 2/2016 Matsui et al.
2016/0031439 A1 2/2016 Nefcy et al.
2016/0052382 A1 2/2016 Clark et al.
2016/0076629 A1 3/2016 Modrzejewski et al.
2016/0082821 A1 3/2016 Mueller et al.
2016/0096522 A1 4/2016 Ortmann et al.
2016/0137045 A1 5/2016 Zhu et al.
2016/0200311 A1 7/2016 Nefcy et al.
2016/0207525 A1 7/2016 Nefcy et al.
2016/0258495 A1 9/2016 Bird
2016/0288780 A1 10/2016 Shukla et al.
2016/0348741 A1 12/2016 Niemiec et al.
2017/0050508 A1 2/2017 Pritchard et al.
2017/0248196 A1 8/2017 Turner et al.

(56) References Cited

U.S. PATENT DOCUMENTS

| | | | | |
|---|---|---|---|---|
| 2017/0328470 | A1 | 11/2017 | Pohl et al. | |
| 2017/0368925 | A1 | 12/2017 | Maki | |
| 2018/0100564 | A1 | 4/2018 | Fliearman et al. | |
| 2018/0106365 | A1 | 4/2018 | Tsukizaki et al. | |
| 2018/0149247 | A1 | 5/2018 | Rekow et al. | |
| 2018/0172124 | A1 | 6/2018 | Valente et al. | |
| 2018/0186230 | A1 | 7/2018 | Fukuda et al. | |
| 2018/0236864 | A1 | 8/2018 | Imamura et al. | |
| 2018/0238443 | A1 | 8/2018 | Aulin et al. | |
| 2018/0244145 | A1 | 8/2018 | Ohnemus et al. | |
| 2018/0298993 | A1 | 10/2018 | Fliearman et al. | |
| 2019/0084555 | A1 | 3/2019 | Omura et al. | |
| 2019/0160936 | A1 | 5/2019 | Lubben et al. | |
| 2019/0176609 | A1 | 6/2019 | Bando | |
| 2019/0176806 | A1 | 6/2019 | Trent | |
| 2019/0219022 | A1 | 7/2019 | Patil et al. | |
| 2019/0344655 | A1 | 11/2019 | Pettersson | |
| 2019/0351751 | A1 | 11/2019 | Sato et al. | |
| 2020/0331337 | A1* | 10/2020 | Fliearman | B60K 6/547 |
| 2020/0331338 | A1 | 10/2020 | Fliearman et al. | |
| 2020/0332754 | A1* | 10/2020 | Fliearman | F02N 15/022 |
| 2020/0332756 | A1* | 10/2020 | Fliearman | F02N 11/006 |
| 2020/0332757 | A1* | 10/2020 | Fliearman | B60K 6/387 |
| 2020/0332864 | A1* | 10/2020 | Fliearman | F16D 41/00 |
| 2020/0332865 | A1* | 10/2020 | Fliearman | F16H 3/76 |
| 2020/0332866 | A1* | 10/2020 | Fliearman | F16H 63/304 |
| 2020/0332867 | A1* | 10/2020 | Fliearman | F16H 3/666 |
| 2020/0332868 | A1* | 10/2020 | Fliearman | F02N 11/14 |
| 2021/0372503 | A1* | 12/2021 | Fliearman | F16H 3/66 |
| 2021/0372504 | A1* | 12/2021 | Fliearman | F16H 61/32 |
| 2022/0267990 | A1* | 8/2022 | Fliearman | E02F 9/2278 |
| 2022/0267991 | A1* | 8/2022 | Dhanal | F16D 11/14 |

FOREIGN PATENT DOCUMENTS

| | | | |
|---|---|---|---|
| DE | 3120675 | A1 | 2/1982 |
| DE | 3444562 | A1 | 6/1985 |
| DE | 69218975 | T2 | 6/1994 |
| DE | 69008994 | T2 | 12/1994 |
| DE | 10007959 | A1 | 9/1998 |
| DE | 19745995 | A1 | 9/1998 |
| DE | 19927521 | A1 | 6/2000 |
| DE | 19911924 | A1 | 9/2000 |
| DE | 19923316 | A1 | 11/2000 |
| DE | 10003741 | A1 | 4/2001 |
| DE | 10103726 | A1 | 8/2002 |
| DE | 102006037576 | A1 | 4/2008 |
| DE | 112007000573 | | 1/2009 |
| DE | 102010007612 | | 10/2010 |
| DE | 102010005178 | | 11/2010 |
| DE | 102010030570 | A1 | 12/2011 |
| DE | 102010030571 | A1 | 12/2011 |
| DE | 102010060140 | A1 | 4/2012 |
| DE | 102011080068 | A1 | 1/2013 |
| DE | 102011089708 | A1 | 6/2013 |
| DE | 102011089709 | A1 | 6/2013 |
| DE | 102011089710 | A1 | 6/2013 |
| DE | 112011103973 | T5 | 10/2013 |
| DE | 102008045202 | A1 | 3/2014 |
| DE | 102013203009 | A1 | 8/2014 |
| DE | 102013012747 | A1 | 9/2014 |
| DE | 102013206970 | A1 | 10/2014 |
| DE | 102013209022 | A1 | 11/2014 |
| DE | 102014200720 | A1 | 2/2015 |
| DE | 102014200723 | B3 | 2/2015 |
| DE | 102013219948 | A1 | 4/2015 |
| DE | 102014225298 | A1 | 7/2015 |
| DE | 112014000378 | T5 | 9/2015 |
| DE | 112014000411 | T5 | 10/2015 |
| DE | 102017203026 | A1 | 8/2017 |
| DE | 102017204269 | A1 | 9/2017 |
| DE | 112016004789 | | 7/2018 |
| DE | 102018122936 | | 3/2020 |
| DE | 102019204909 | A1 | 10/2020 |
| DE | 102020204705 | A1 | 10/2020 |
| DE | 102020204795 | A1 | 10/2020 |
| DE | 102022200804 | A1 | 8/2022 |
| EP | 0384808 | A1 | 9/1991 |
| EP | 645271 | B1 | 3/1995 |
| EP | 0391386 | B1 | 9/1995 |
| EP | 2272702 | A2 | 1/2011 |
| EP | 2664785 | | 11/2013 |
| EP | 1069310 | B4 | 3/2014 |
| GB | 650564 | | 2/1951 |
| GB | 2506199 | A | 3/2014 |
| JP | 04296649 | A | 10/1992 |
| JP | 2003267079 | A | 9/2003 |
| JP | 2015116004 | A | 6/2015 |
| WO | 1999023398 | A2 | 5/1999 |
| WO | 0188369 | A1 | 11/2001 |
| WO | 2007107458 | A2 | 9/2007 |
| WO | 2012078203 | A1 | 6/2012 |
| WO | 2018028745 | | 2/2018 |

OTHER PUBLICATIONS

USPTO Non-Final Office Action dated May 13, 2022 for U.S. Appl. No. 17/185,713.

NTN Automotive Sales Headquarters, Compact Clutch Integrated Pulley for Alternators, NTN Technical Review No. 75, 2007.

Harmonic Drive LLC, Harmonic Planetary Precision Gearing & Motion Control, Product Brochure, Mar. 2006.

Ioan-Adrian Viorel et al., Integrated Starter-Generators for Automotive Applications, Technical University of Cluj-Romania, Dept. of Electrical Machines, vol. 45, No. 3, 2004.

North Atalantic Starter, Starter Drives Explained, Northatlan.com, 2005.

German Search Report for application No. 1020172030267 dated Aug. 4, 2017.

German Search Report for application No. 1020182189080 dated May 27, 2019.

German Search Report for application No. 1020182214956 dated May 28, 2019.

German Search Report for application No. 1020182180784 dated Jun. 4, 2019.

German Search Report for application No. 1020202046468 dated Sep. 1, 2020.

German Search Report for application No. 1020202047057 dated Sep. 1, 2020.

German Search Report for application No. 1020202047952 dated Sep. 2, 2020.

German Search Report for application No. 1020202047049 dated Sep. 3, 2020.

German Search Report for application No. 1020202047065 dated Sep. 3, 2020.

German Search Report for application No. 1020202049433 dated Sep. 4, 2020.

German Search Report for application No. 1020202030634 dated Sep. 4, 2020.

German Search Report for application No. 1020202046425 dated Sep. 4, 2020.

USPTO Final Office Action dated Mar. 8, 2019 for U.S. Utility U.S. Appl. No. 15/056,767.

USPTO Final Office Action dated Jun. 11, 2018 for U.S. Utility U.S. Appl. No. 15/056,767.

USPTO Non-Final Office Action dated Sep. 9, 2019 for U.S. Appl. No. 15/834,356.

USPTO Non-Final Office Action dated Nov. 2, 2017 for U.S. Appl. No. 15/056,767.

USPTO Non-Final Office Action dated Sep. 28, 2018 for U.S. Appl. No. 15/056,767.

USPTO Non-Final Office Action dated Nov. 1, 2018 for U.S. Appl. No. 15/825,520.

USPTO Non-Final Office Action dated Feb. 25, 2019 for U.S. Appl. No. 15/834,356.

USPTO Non-Final Office Action dated Mar. 4, 2020 for U.S. Appl. No. 16/385,934.

USPTO Non-Final Office Action dated Jun. 19, 2020 for U.S. Appl. No. 16/386,075.

(56) References Cited

OTHER PUBLICATIONS

USPTO Non-Final Office Action dated Aug. 24, 2020 for U.S. Appl. No. 16/385,964.
USPTO Non-Final Office Action dated Aug. 24, 2020 for U.S. Appl. No. 16/385,784.
USPTO Non-Final Office Action dated Nov. 4, 2020 for U.S. Appl. No. 16/385,860.
USPTO Non-Final Office Action dated Oct. 30, 2020 for U.S. Appl. No. 16/386,052.
Deere & Company, U.S. Appl. No. 17/032,114, filed Sep. 25, 2020.
Deere & Company, U.S. Appl. No. 16/887,973, filed May 29, 2020.
Deere & Company, U.S. Appl. No. 16/887,998, filed May 29, 2020.
Deere & Company, U.S. Appl. No. 17/080,562, filed Oct. 26, 2020.
Deere & Company, U.S. Appl. No. 17/185,692, filed Feb. 25, 2021.
Deere & Company, U.S. Appl. No. 17/185,713, filed Feb. 25, 2021.
USPTO non-final office action issued in pending U.S. Appl. No. 16/887,973 dated Jan. 31, 2022.
German Search Report issued in application No. DE102022200804.9 dated Sep. 22, 2022 with machine translation (20 pages).
German Search Report issued in application No. DE102022200825.1 dated Sep. 27, 2022 with machine translation (26 pages).
German Search Report issued in German Application No. 102021113913.9 dated Sep. 30, 2021. (8 pages).
USPTO non-final office action issued in pending U.S. Appl. No. 17/080,562 dated Dec. 6, 2021.
German Search Report issued in application No. DE 102021209339.6 dated Feb. 15, 2022 with translation, 17 pages.
German Search Report issued in application No. DE102022206133.0 dated Oct. 12, 2022 with machine translation (26 pages).
USPTO Non-Final Office Action issued in U.S. Appl. No. 17/325,437 dated Feb. 9, 2023 9 pages.
German Search Report issued in application No. DE 102022203350.7 dated Jan. 17, 2023 with translation 12 pages.
USPTO Non-Final Office Action issued in U.S. Appl. No. 17/185,692 dated Apr. 21, 2023 9 pages.

* cited by examiner

INTEGRATED STARTER-GENERATOR DEVICE WITH UNIDIRECTIONAL CLUTCH ACTUATION UTILIZING BIASED LEVER ASSEMBLY

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicle power systems, including arrangements for starting mechanical power equipment and generating electric power therefrom.

BACKGROUND OF THE DISCLOSURE

Work vehicles, such as those used in the agriculture, construction and forestry industries, and other conventional vehicles may be powered by an internal combustion engine (e.g., a diesel engine), although it is becoming more common for mixed power sources (e.g., engines and electric motors) to be employed. In any case, engines remain the primary power sources of work vehicles and require mechanical input from a starter to initiate rotation of the crankshaft and reciprocation of the pistons within the cylinders. Torque demands for starting an engine are high, particularly so for large diesel engines common in heavy-duty machines.

Work vehicles additionally include subsystems that require electric power. To power these subsystems of the work vehicle, a portion of the engine power may be harnessed using an alternator or generator to generate AC or DC power. The battery of the work vehicle is then charged by inverting the current from the alternator. Conventionally, a belt, direct or serpentine, couples an output shaft of the engine to the alternator to generate the AC power. Torque demands for generating current from the running engine are significantly lower than for engine start-up. In order to appropriately transfer power between the engine and battery to both start the engine and generate electric power, a number of different components and complex devices are typically required, thereby raising issues with respect to cost, assembly errors, and complexity.

SUMMARY OF THE DISCLOSURE

This disclosure provides a combined engine starter and electric power generator device with an integral transmission, such as may be used in work vehicles for engine cold start and to generate electric power, thus serving the dual purposes of an engine starter and an alternator for power transmission to and from the engine with more robust construction of an actuation assembly for engaging gears of a transmission.

In one aspect, the disclosure provides a combination starter-generator device for a work vehicle having an engine. The starter-generator device includes a housing arrangement having one or more housing elements forming a stationary reaction member and a gear set configured to transmit power flow to and from the engine. The device also includes a clutch arrangement having one or more portions configured to selectively interact with the gear set to modify power flow through the gear set, an actuator device having an armature, the actuator device operable to power movement of the armature in a first axial direction to apply a push force, and a linkage coupled between the actuator device and a portion of the clutch arrangement. The linkage has a first end proximal to the reaction member, a first portion extending from the first end, and a second portion extending radially from the first portion to a second end. The first portion includes a neck region formed as a permanent bend having a bend radius and the second portion incudes a coupling region configured to interact with the armature, a stiffened region, and a connection region at the second end. The device further includes an actuation pin connected to the connection region and the portion of the clutch arrangement. The linkage is formed from a flexible resilient material and is movable in a powered stroke from an undeformed, unloaded condition to an elastically deformed, loaded condition by application of the push force. The linkage is movable in a return stroke from the elastically deformed, loaded condition to the undeformed, unloaded condition under an elastic return force with the push force removed. The second end is displaced in one of the first axial direction and a second axial direction in the powered stroke to reposition the portion of the clutch arrangement in the same one of the first axial direction and the second axial direction. The second end is moved in the other of the first axial direction and the second axial direction in the return stroke to reposition the portion of the clutch arrangement in the same other of the first axial direction and the second axial direction.

In another aspect, the disclosure provides a combination starter-generator device for a work vehicle having an engine. The starter-generator device includes a housing arrangement having one or more housing elements forming a stationary reaction member, an input shaft extending within the housing arrangement, the input shaft rotatable on a drive axis, a sliding shaft rotationally fixed to the input shaft and axially slidable relative to input shaft and a gear set configured to transmit power flow to and from the engine. The gear set interfaces with the sliding shaft for rotation. The device also includes a first clutch shiftable into a disengaged position in which the first clutch is decoupled from the gear set and into an engaged position in which the first clutch is coupled to the gear set to effect a first gear ratio, a first actuator device having a first armature, wherein the first actuator device is energized to power movement of the first armature to apply a first push force in a first axial direction and is deenergized to remove the first push force, a first linkage and a first actuation pin. The first linkage has a first portion secured to the reaction member and extending axially away from the reaction member, and a second portion extending radially inward from the first portion to a first distal end. The first portion includes a first neck region formed as a permanent bend having a first bend radius and a reduced width relative to the second portion. The first distal end is movable in a second axial direction in response to the first push force applied to the second portion of the first linkage to move the first linkage from an undeformed, unloaded condition to an elastically deformed, loaded condition. The first distal end is movable in the first axial direction under an elastic return force of the first linkage in response to removal of the first push force from the second portion of the first linkage to move the first linkage from the elastically deformed, loaded condition to the undeformed, unloaded condition. The first actuation pin is connected to the first distal end of the first linkage and the first clutch such that movement of the first distal end in one of the first axial direction and the second axial direction causes movement of the first actuation pin to reposition the first clutch in the same one of the first axial direction and the second axial direction. The device further includes a second clutch shiftable into a disengaged position in which the second clutch is decoupled from the gear set and into an engaged position in which the second clutch is coupled to the gear set to effect a second gear ratio higher than the first gear ratio, a second actuator device having a second armature, wherein the second actuator device is energized to power movement of the second armature to apply a second push force in the first axial direction and is deenergized to remove the second push force, a second linkage and a second actuation pin. The second linkage has a first portion secured to the reaction member and extending axially away from the reaction member, and a second portion extending radially inward from the first portion to a second distal end, the first portion including a second neck region formed as a permanent bend having a second bend radius and a reduced width relative to the second portion. The second distal end is movable in the first axial direction in response to the second push force applied to the second portion of the second linkage to move the second linkage from an undeformed, unloaded condition to an elastically deformed, loaded condition. The second distal end is movable in the second axial direction under an elastic return force of the second linkage in response to removal of the second push force from the second portion of the second linkage to move the second linkage from the elastically deformed, loaded condition to the undeformed, unloaded condtion. The second actuation pin is connected to the second distal end of the second linkage and the second clutch such that movement of the second distal end in one of the first axial direction and the second axial direction causes movement of the second actuation pin to reposition the second clutch in the same one of the first axial direction and the second axial direction.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
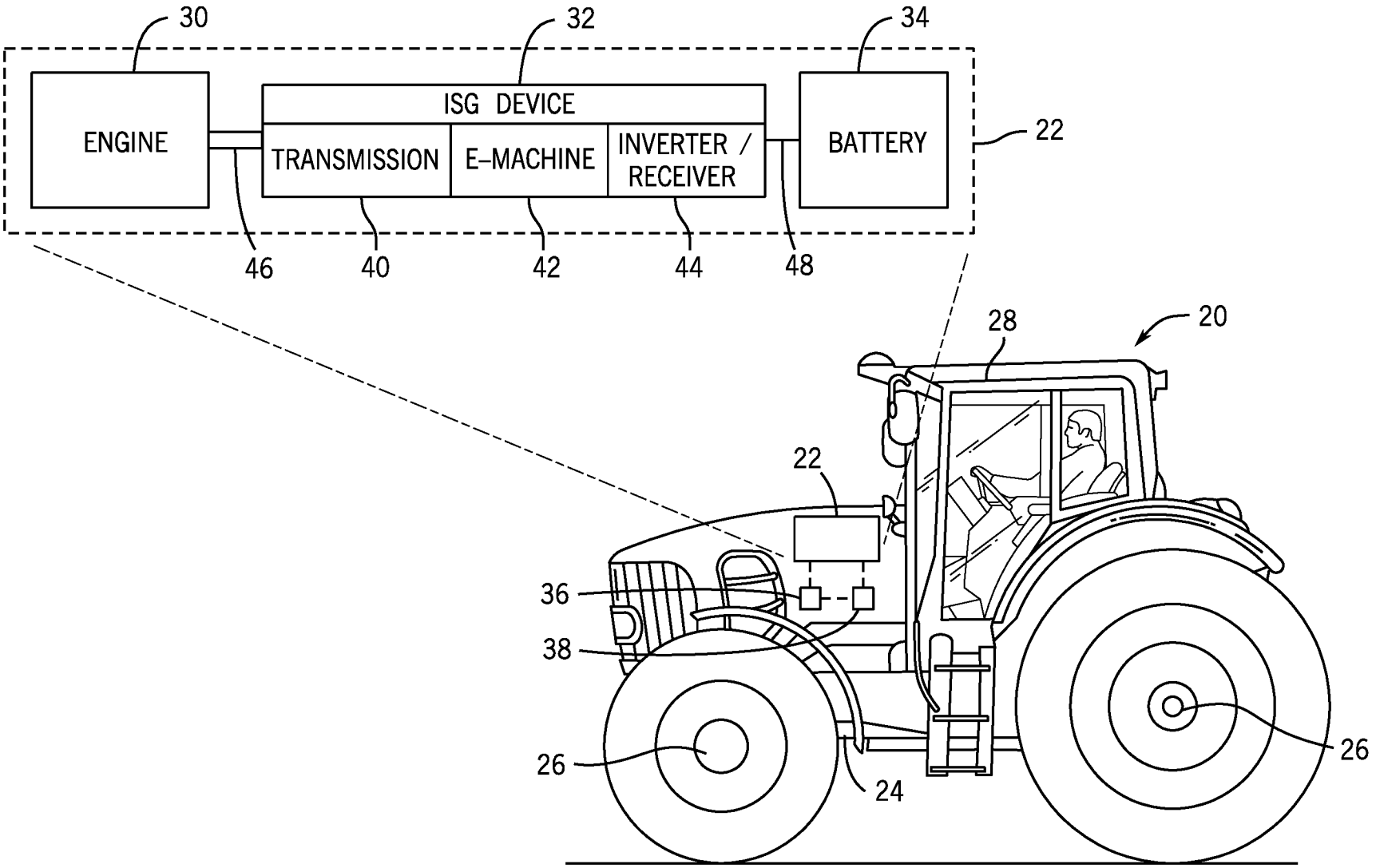
FIG. 1 is a schematic side view of an example work vehicle in the form of an agricultural tractor in which the disclosed integrated starter-generator device may be used.

The following describes one or more example embodiments of the disclosed starter-generator device, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As used herein, the term "axial" refers to a dimension that is generally parallel to an axis of rotation, axis of symmetry, or centerline of a component or components. For example, in a cylinder or disc with a centerline and opposite, generally circular ends or faces, the "axial" dimension may refer to the dimension that generally extends in parallel to the centerline between the opposite ends or faces. In certain instances, the term "axial" may be utilized with respect to components that are not cylindrical (or otherwise radially symmetric). For example, the "axial" dimension for a rectangular housing containing a rotating shaft may be viewed as a dimension that is generally in parallel with the rotational axis of the shaft. Furthermore, the term "radially" as used herein may refer to a dimension or a relationship of components with respect to a line extending outward from a shared centerline, axis, or similar reference, for example in a plane of a cylinder or disc that is perpendicular to the centerline or axis. In certain instances, components may be viewed as "radially" aligned even though one or both of the components may not be cylindrical (or otherwise radially symmetric). Furthermore, the terms "axial" and "radial" (and any derivatives) may encompass directional relationships that are other than precisely aligned with (e.g., oblique to) the true axial and radial dimensions, provided the relationship is predominately in the respective nominal axial or radial dimension. Additionally, the term "circumferential" may refer to a collective tangential dimension that is perpendicular to the radial and axial dimensions about an axis.

Overview

Vehicle power systems may include an internal combustion engine and/or one or more batteries (or other chemical power source) that power various components and subsystems of the vehicle. In certain electric vehicles, a bank of batteries powers the entire vehicle including the drive wheels to impart motion to the vehicle. In hybrid gas and electric vehicles, the motive force may alternate between engine and electric motor power, or the engine power may be supplemented by electric motor power. In still other vehicles, the electric power system is used to initiate engine start up and to run the non-drive electric systems of the vehicle. In the latter case, the vehicle typically has a starter motor that is powered by the vehicle battery to turn the engine crankshaft to move the pistons within the cylinders. In further scenarios, the electric power system may provide a boost to an operating engine.

Some engines (e.g., diesel engines) initiate combustion by compression of the fuel, while other engines rely on a spark generator (e.g., spark plug), which is powered by the battery. Once the engine is operating at a sufficient speed, the power system may harvest the engine power to power the electric system as well as to charge the battery. Typically, this power harvesting is performed with an alternator or other type of power generator. The alternator converts alternating current (AC) power to direct current (DC) power usable by the battery and vehicle electric components by passing the AC power through an inverter (e.g., diode rectifier). Conventional alternators harness power from the engine by coupling a rotor of the alternator to an output shaft of the engine (or a component coupled thereto). Historically this was accomplished by the use of a dedicated belt, but in some more modern vehicles the alternator is one of several devices that are coupled to (and thus powered by) the engine via a single "serpentine" belt.

In certain applications, such as in certain heavy-duty machinery and work vehicles such as agricultural tractors, it may be disadvantageous to have separate starter and generator components. Such separate components require separate housings, which may require separate sealing or shielding from the work environment and/or occupy separate positions within the limited space of the engine compartment. Other engine compartment layout complexities may arise as well.

The following describes one or more example implementations of an improved vehicle power system that addresses one or more of these (or other) matters with conventional systems. In one aspect, the disclosed system includes a combination or integrated device that performs the engine cranking function of a starter motor and the electric power generating function of a generator. The device is referred to herein as an integrated starter-generator device ("ISG" or "starter-generator"). This terminology is used herein, at least in some implementations of the system, to be agnostic to the type of power (i.e., AC or DC current) generated by the device. In some implementations, the starter-generator device may function to generate electricity in a manner of what persons of skill in the art may consider a "generator" device that produces DC current directly. However, as used herein, the term "generator" shall mean producing electric power of static or alternating polarity (i.e., AC or DC). Thus, in a special case of the starter-generator device, the electric power generating functionality is akin to that of a conventional alternator, and it generates AC power that is subsequently rectified to DC power, either internally or externally to the starter-generator device.

In certain embodiments, the starter-generator device may include a direct mechanical power coupling to the engine that avoids the use of belts between the engine and the starter-generator device. For example, the starter-generator device may include within its housing a power transmission assembly with a gear set that directly couples to an output shaft of the engine. The gear set may take any of various forms including arrangements with enmeshing spur or other gears as well as arrangements with one or more planetary gear sets. Large gear reduction ratios may be achieved by the transmission assembly such that a single electric machine (i.e., motor or generator) may be used and operated at suitable speeds for one or more types of engine start up, as well as electric power generation. The direct power coupling between the starter-generator device and engine may increase system reliability, cold starting performance, and electric power generation of the system.

Further, in certain embodiments, the starter-generator device may have a power transmission assembly that automatically and/or selectively shifts gear ratios (i.e., shifts between power flow paths having different gear ratios). By way of example, the transmission assembly may include one or more passive or active engagement components that engage or disengage to effect power transmission through a power flow path. In this manner, bi-directional or other clutch (or other) configurations may be employed to carry out the cranking and generating functions with the appropriate control hardware. As a result of the bi-directional nature of the power transmission assembly, the power transfer belt arrangement may be implemented with only a single belt tensioner, thereby providing a relatively compact and simple assembly. In addition to providing torque in two different power flow directions, the gear set may also be configured and arranged to provide power transmission from the electric machine to the engine at one of two different speeds, e.g., according to different gear ratios. The selection of speed may provide additional functionality and flexibility for the power transmission assembly.

In one example, the combination starter-generator may further include a clutch arrangement with first, second, and third clutches that are actuated with an actuation assembly. The actuation assembly employs actuators that are powered in only one direction, such as push-only or pull-only electromechanical solenoids, also referred to herein as "unidirectional actuators." Such unidirectional actuators may also be less costly than more complicated alternatives. The actuators function to reposition the clutches to engage and/or disengage a gear set of a power transmission assembly. In certain examples, each actuator device includes an armature movable in an axial direction in response to the actuation device being energized. The armatures are connected via corresponding linkage assemblies to the clutches, thereby axially shifting the clutches between engaged and disengaged positions to modify the power flow within the power transmission assembly.

Moreover, the actuator devices are mounted with one orientation on only one side of a housing component. The actuator devices may be identical to each other regardless of the desired movement of a respective clutch. In certain examples, the actuator devices may be push-only solenoids that are each mounted on an axial side of a base of a housing component that is oriented away from the clutches and the gear set.

A linkage assembly connected between an armature and a clutch is formed from a material that is flexible within the elastic limit, i.e., a resilient, elastically deformable material. The linkage includes a first portion extending generally in an axial direction and a second portion extending from the first portion generally in a radial direction. The first portion includes a neck region formed as a permanent bend having a bend radius. The permanent bend has a reduced width relative to the second portion and is configured to elastically deform in response to the armature applying a push force to the second portion. In a first example linkage, the second portion is elastically deflected by the push force to interact with a fulcrum such that the distal end of the second portion is displaced in a direction opposite to the direction of the push force to reposition a corresponding first portion of the clutch arrangement. In a second example linkage, at least one region of the second portion is elastically deflected generally in the direction of the push force without interacting with a fulcrum. In turn, the distal end of the second portion is displaced in the direction of the push force to reposition the corresponding second portion the clutch arrangement. In both examples, the linkages function as levers to reposition corresponding clutch portions in response to the push force being applied to the second portion (i.e., in response to the actuator being energized).

The linkage returns to an undeformed condition under the elastic restoration force when the push force from the armature is released, i.e., in response to the actuator device being deenergized. The second portion, during return movement under the restoration force, causes the armature to move in a direction opposite to the direction of the push force. In the first example linkage, the second portion interacts with fulcrum, during return movement, such that the distal end moves in a direction of the push force to reposition the corresponding first portion of the clutch arrangement. In the second example linkage, the distal end moves in a direction opposite to the direction of the push force during return movement to reposition the corresponding second portion of the clutch arrangement. In both examples, the linkages function as return springs to reposition corresponding clutch portions in response to the push force being removed from the second portion (i.e., the actuator being deenergized).

Implementations of the example actuation assembly may include one or more of the first example linkages, one or more of the second example linkages, or a combination including one or more first example linkages and one or more second example linkages.

The disclosed combination starter-generator device may provide advantageous timing and costs for manufacture, assembly, and repair. The unidirectional actuators are low cost and are implemented throughout the actuation assembly. Certain components may be consolidated as unitary parts of one component, which enhances these benefits. For example, the linkages may be formed as a unitary part of a base of the housing. In other examples, the fulcrums are formed as unitary parts of a cover of the housing. Moreover, actuation pins of the clutches may be formed as unitary parts of the clutches.

Various implementations are discussed below.

Example Embodiments of the Work Vehicle and Integrated Starter-Generator Device Referring to the drawings, an example work vehicle power system as a drivetrain assembly will be described in detail. As will become apparent from the discussion herein, the disclosed system may be used advantageously in a variety of settings and with a variety of machinery. For example, referring now to FIG. 1, a work vehicle 20 such as an agricultural tractor includes a power system (or drivetrain assembly) 22. It will be understood, however, that other configurations may be possible, including configurations with work vehicle 20 as a different kind of tractor, or as a work vehicle used for other aspects of the agriculture industry or for the construction and forestry industries (e.g., a harvester, a log skidder, a motor grader, and so on). It will further be understood that aspects of the power system 22 may also be used in non-work vehicles and non-vehicle applications (e.g., fixed-location installations).

Briefly, the work vehicle 20 has a main frame or chassis 24 supported by ground-engaging wheels 26, at least the front wheels of which are steerable. The chassis 24 supports the power system 22 and an operator cabin 28 in which operator interface and controls (e.g., various joysticks, switches levers, buttons, touchscreens, keyboards, speakers and microphones associated with a speech recognition system) are provided.

As schematically shown, the power system 22 includes an engine 30, an integrated starter-generator device 32, a battery 34, and a controller 36. The engine 30 may be an internal combustion engine or other suitable power source that is suitably coupled to propel the work vehicle 20 via the wheels 26, either autonomously or based on commands from an operator. The battery 34 may represent any one or more suitable energy storage devices that may be used to provide electric power to various systems of the work vehicle 20.

The starter-generator device 32 couples the engine 30 to the battery 34 such that the engine 30 and battery 34 may selectively interact in at least four modes. In a first (or cold engine start) mode, the starter-generator device 32 converts electric power from the battery 34 into mechanical power to drive the engine 30 at a first gear ratio corresponding to a relatively high speed, e.g., during a relatively cold engine temperature at start up. In a second (or warm engine start) mode, the starter-generator device 32 converts electric power from the battery 34 into mechanical power to drive the engine 30 at a second gear ratio corresponding to a relatively low speed, e.g., during a relatively warm engine temperature at start up. In a third (or boost) mode, the starter-generator device 32 converts electric power from the battery 34 into mechanical power at a third gear ratio corresponding to a relatively low speed to drive the engine 30 for an engine boost. In a fourth (or generation) mode, the starter-generator device 32 converts mechanical power at a fourth (or the third) gear ratio from the engine 30 into electric power to charge the battery 34.

The controller 36 may be configured to control various aspects of the work vehicle 20, including characteristics of the power system 22. The controller 36 may be a work vehicle electronic controller unit (ECU) or a dedicated controller. In some embodiments, the controller 36 may be configured to receive input commands and to interface with an operator via a human-machine interface or operator interface (not shown) and from various sensors, units, and systems onboard or remote from the work vehicle 20. In response, the controller 36 generates one or more types of commands for implementation by the power system 22 and/or various systems of work vehicle 20. In one example, the controller 36 may command current to electromagnets associated with an actuator assembly to engage and/or disengage clutches within the starter-generator device 32. Other mechanisms for controlling such clutches may also be provided.

Generally, the controller 36 may be configured as one or more computing devices with associated processor devices and memory architectures, as hydraulic, electrical or electro-hydraulic controllers, or otherwise, and combinations thereof. As such, the controller 36 may be configured to execute various computational and control functionality with respect to the power system 22 (and other machinery). The controller 36 may be in electronic, hydraulic, or other communication with various other systems or devices of the work vehicle 20. For example, the controller 36 may be in electronic or hydraulic communication with various actuators, sensors, and other devices within (or outside of) the work vehicle 20, including various devices associated with the power system 22. Generally, the controller 36 generates the command signals based on operator input, operational conditions, and routines and/or schedules stored in the memory. For example, the operator may provide inputs to the controller 36 via an operator input device that dictates the appropriate mode, or that at least partially defines the operating conditions in which the appropriate mode is selected by the controller 36. In some examples, the controller 36 may additionally or alternatively operate autonomously without input from a human operator. The controller 36 may communicate with other systems or devices (including other controllers) in various known ways, including via a CAN bus (not shown), via wireless or hydraulic communication means, or otherwise.

Additionally, power system 22 and/or work vehicle 20 may include a hydraulic system 38 with one or more electro-hydraulic control valves (e.g., solenoid valves) that facilitate hydraulic control of various vehicle systems, including aspects of the starter-generator device 32. The hydraulic system 38 may further include various pumps, lines, hoses, conduits, tanks, and the like. The hydraulic system 38 may be electrically activated and controlled according to signals from the controller 36. The hydraulic system 38 may be omitted in some examples.

In one example, the starter-generator device 32 includes a power transmission assembly (or transmission) 40, an electric machine (or motor) 42, and an inverter/rectifier device 44, each of which may be operated according to command signals from the controller 36. The power transmission assembly 40 enables the starter-generator device 32 to interface with the engine 30, for example, via a crank shaft 46 or other power transfer element of the engine 30, such as an auxiliary drive shaft. The power transmission assembly 40 may include one or more gear sets in various configurations to provide suitable power flows and gear reductions, as described below. The power transmission assembly 40 variably interfaces with the electric machine 42 in one or two different power flow directions such that the electric machine 42 operates as a motor during the engine start and boost modes and as a generator during the generation mode. In one example discussed below, the power transmission assembly 40 is coupled to the electric machine 42 via a power transfer belt arrangement. This arrangement, along with the multiple gear ratios provided by the power transmission assembly 40, permits the electric machine 42 to operate within optimal speed and torque ranges in one or both power flow directions. The inverter/rectifier device 44 enables the starter-generator device 32 to interface with the battery 34, such as via direct hardwiring or a vehicle power bus 48. In one example, the inverter/rectifier device 44 inverts DC power from the battery 34 into AC power during the engine start modes and rectifies AC power to DC power in the generation mode. In some embodiments, the inverter/rectifier device 44 may be a separate component instead of being incorporated into the starter-generator device 32. Although not shown, the power system 22 may also include a suitable voltage regulator, either incorporated into the starter-generator device 32 or as a separate component.

Figure 2:
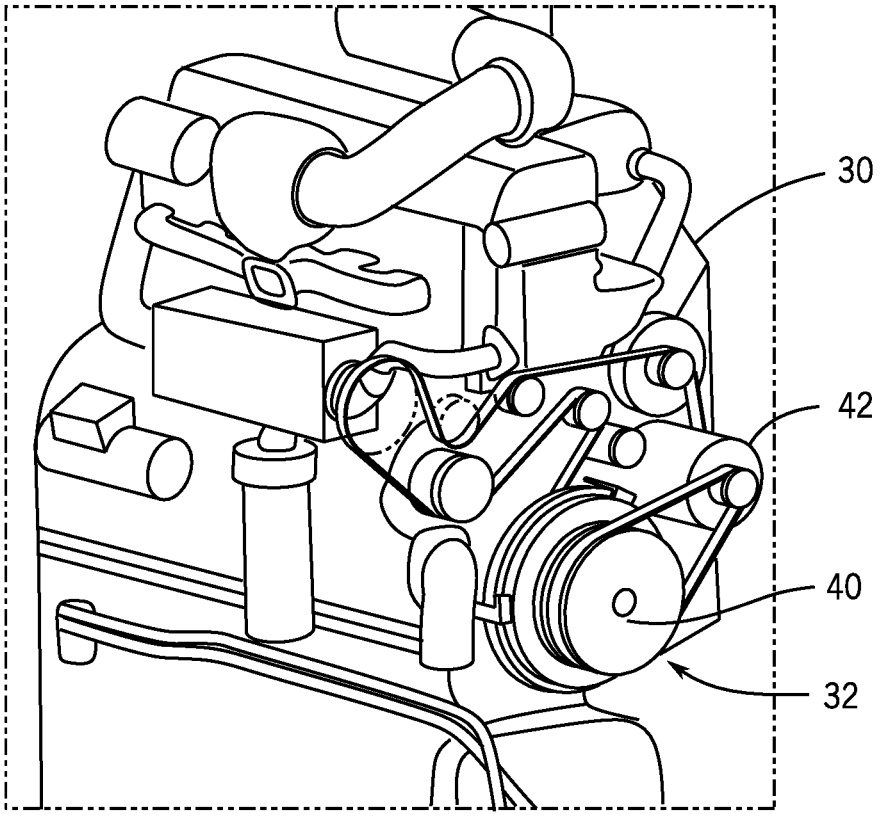
FIG. 2 is a simplified partial isometric view of an engine of the work vehicle of FIG. 1 showing an example mounting location for an example starter-generator device.

Referring to the example depicted in FIG. 2, the integrated starter-generator device 32 mounts directly and compactly to the engine 30 so as not to project significantly from the engine 30 (and thereby enlarge the engine compartment space envelope) or interfere with various plumbing lines and access points (e.g., oil tubes and fill opening and the like). The starter-generator device 32 may generally be mounted on or near the engine 30 in a location suitable for coupling to an engine power transfer element (e.g., a crank shaft 46).

Figure 3:
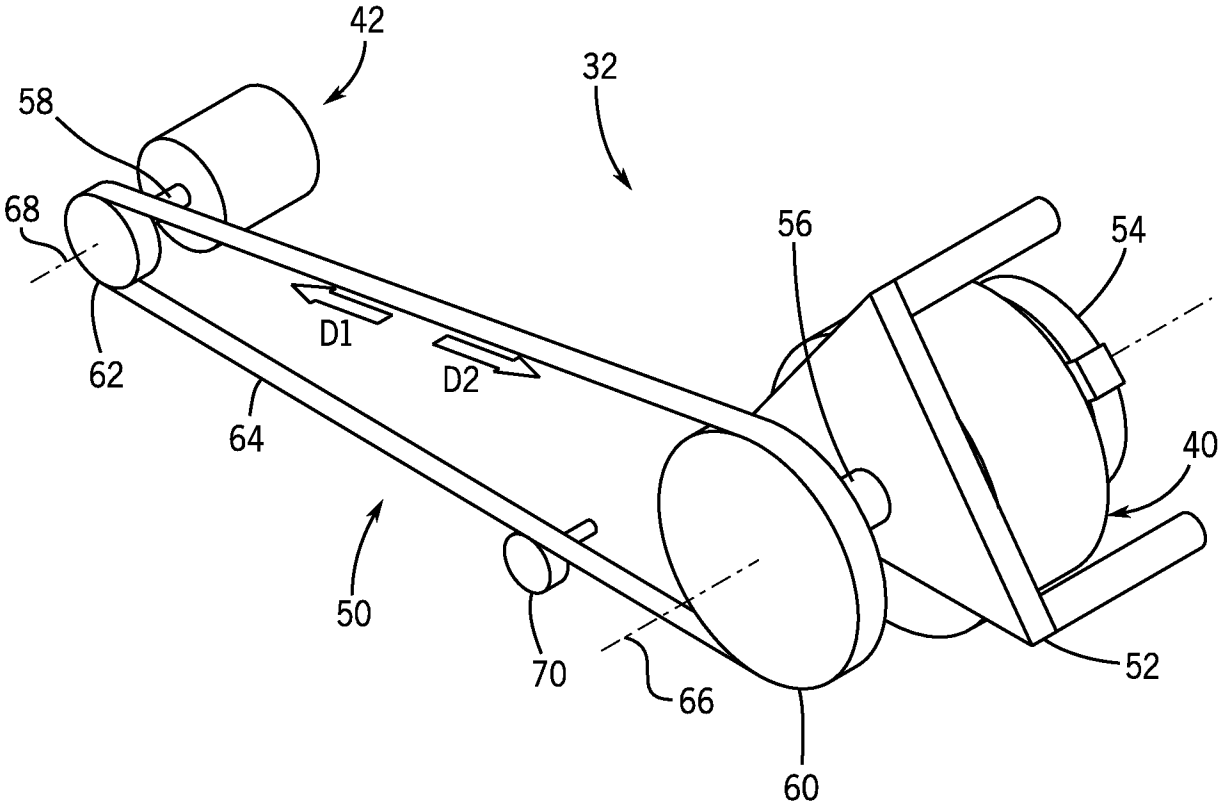
FIG. 3 is a schematic diagram of a portion of a power transfer arrangement of the work vehicle of FIG. 1 having an example starter-generator device.

Reference is additionally made to FIG. 3, which is a simplified schematic diagram of a power transfer belt arrangement 50 between the power transmission assembly 40 and electric machine 42 of the starter-generator device 32. It is noted that FIGS. 2 and 3 depict one example physical integration or layout configuration of the starter-generator device 32, but other arrangements may be provided. In FIG. 3, the power transmission assembly 40 is mounted to the engine 30 and may be supported by a reaction plate 52. As shown, the power transmission assembly 40 includes a first power transfer element 54 that is rotatably coupled to a suitable drive element of the engine 30 and a second power transfer element 56 in the form of a shaft extending on an opposite side of the power transmission assembly 40 from the first power transfer element 54. Similarly, the electric machine 42 is mounted on the engine 30 and includes a further power transfer element 58.

The power transfer belt arrangement 50 includes a first pulley 60 arranged on the second power transfer element 56 of the power transmission assembly 40, a second pulley 62 arranged on the power transfer element 58 of the electric machine 42, and a belt 64 that rotatably couples the first pulley 60 to the second pulley 62 for collective rotation. During the engine start modes, the electric machine 42 pulls the belt 64 to rotate the first and second pullies 60, 62 in a first clock direction D1 to drive the power transmission assembly 40 (and thus the engine 30). During the boost mode, the electric machine 42 pushes the belt 64 to rotate the first and second pullies 60, 62 in the first clock direction D1 to drive the power transmission assembly 40 (and thus the engine 30). During the generation mode, the power transmission assembly 40 enables the engine 30 to pull the belt 64 and rotate the first and second pullies 60, 62 in the second clock direction D2 to drive the electric machine 42. The first pulley 60 defines a primary rotational axis 66 (also referred to herein as the drive axis 66) that may be coaxial with the first power transfer element 54 and other components of the power transmission assembly 40. The second pulley 62 defines a secondary rotational axis 68 that is coaxial with rotation of the electric machine 42. The secondary rotational axis 68 is parallel or substantially parallel with the primary rotational axis 66.

As a result of the bi-directional configuration, the power transfer belt arrangement 50 may include only a single belt tensioner 70 to apply tension to a single side of the belt 64 in both directions D1, D2. Using a single belt tensioner 70 to tension the belt 64 is advantageous in that it reduces parts and complexity in comparison to a design that requires multiple belt tensioners. As described below, the bi-directional configuration and associated simplified power transfer belt arrangement 50 are enabled by the bi-directional nature of the gear set in the power transmission assembly 40. Additionally, a difference in the circumferences of the first and second pullies 60, 62 provides a change in the gear ratio between the power transmission assembly 40 and the electric machine 42. In one example, the power transfer belt arrangement 50 may provide a gear ratio of between 3:1-5:1, particularly a 4:1 ratio.

Figure 4:
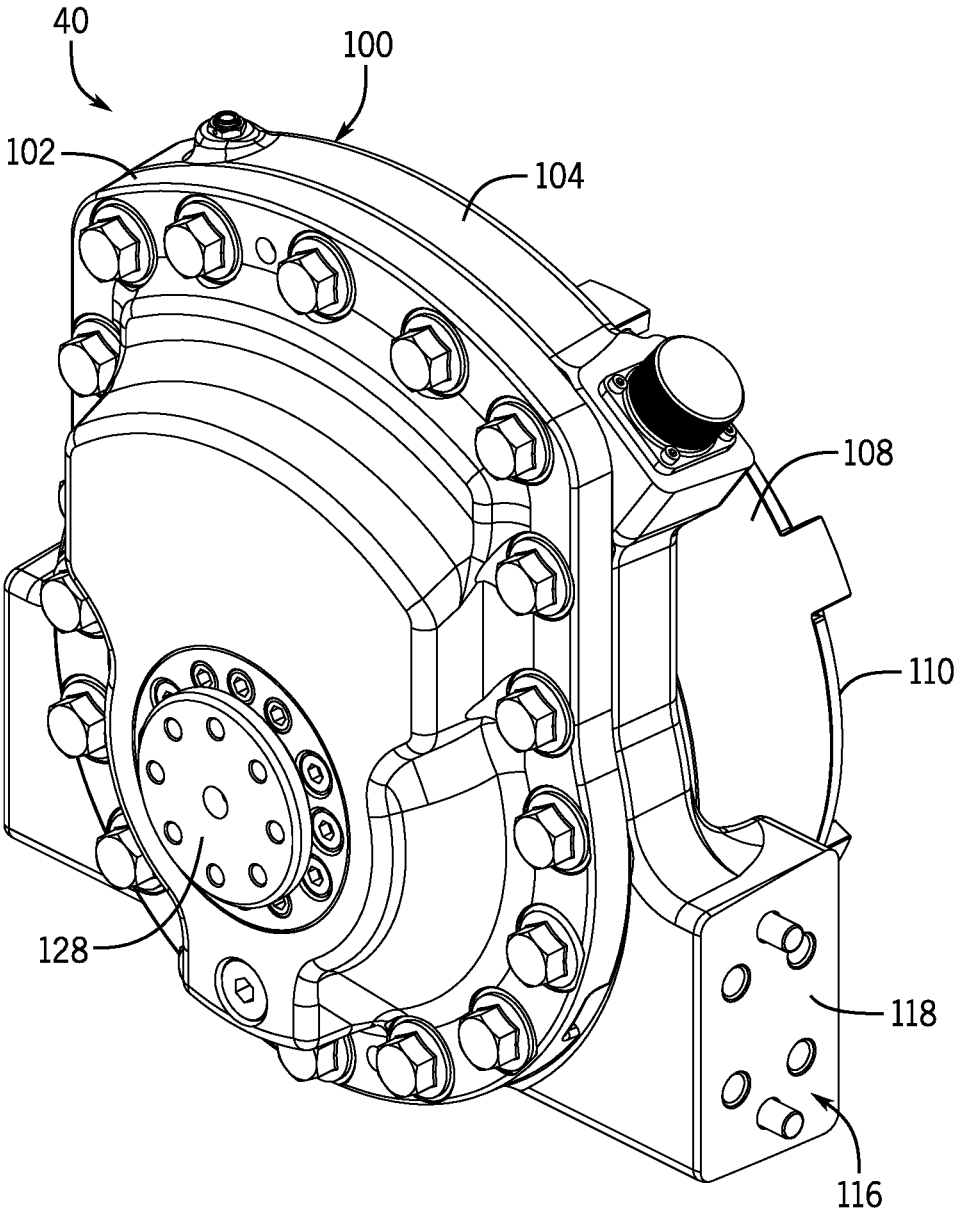
FIG. 4 is an isometric side view of a power transmission assembly of the example starter-generator device that may be implemented in the work vehicle of FIG. 1.
Figure 5:
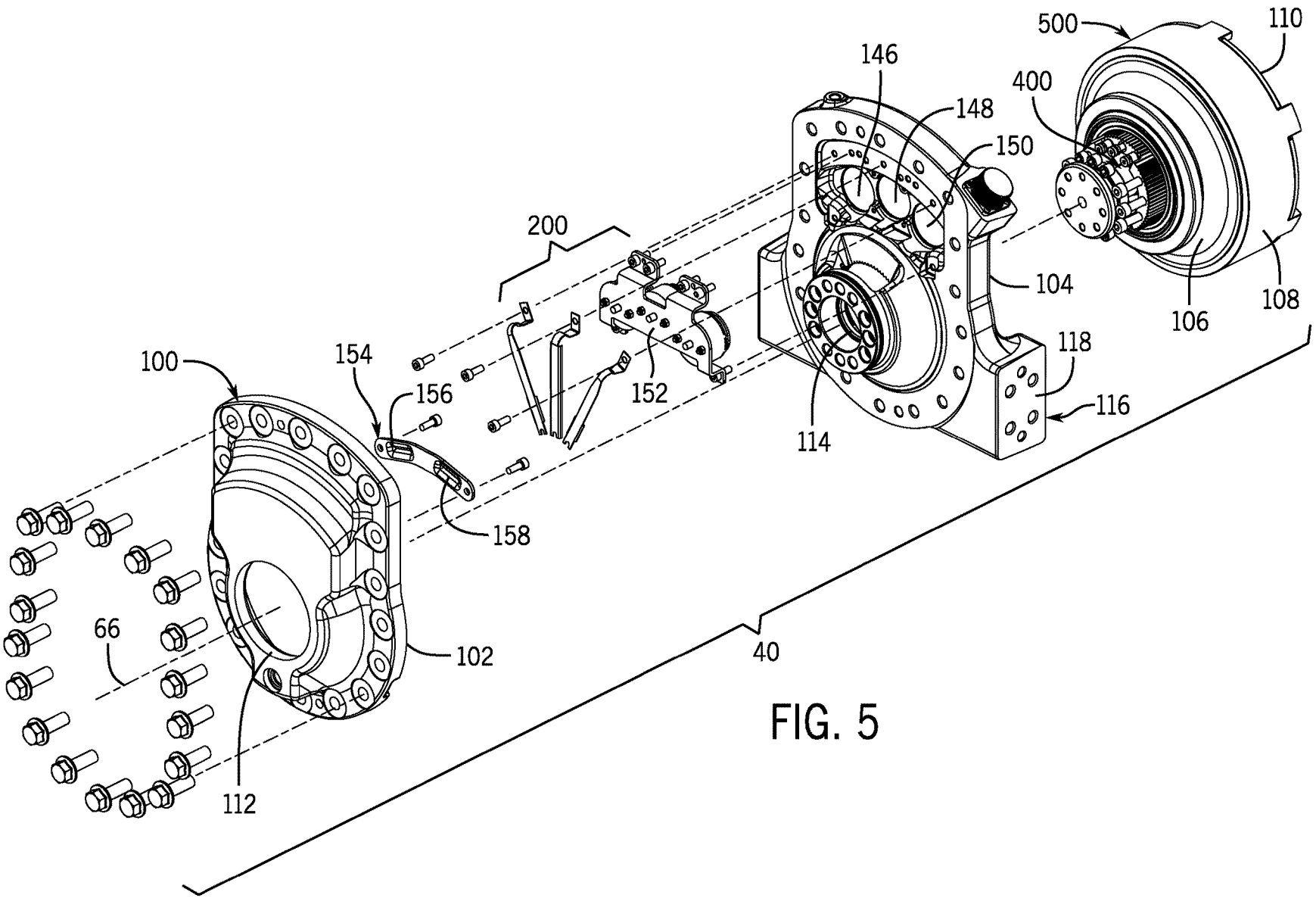
FIG. 5 is an exploded isometric view of the power transmission assembly of FIG. 4 for the example starter-generator device.
Figure 6:
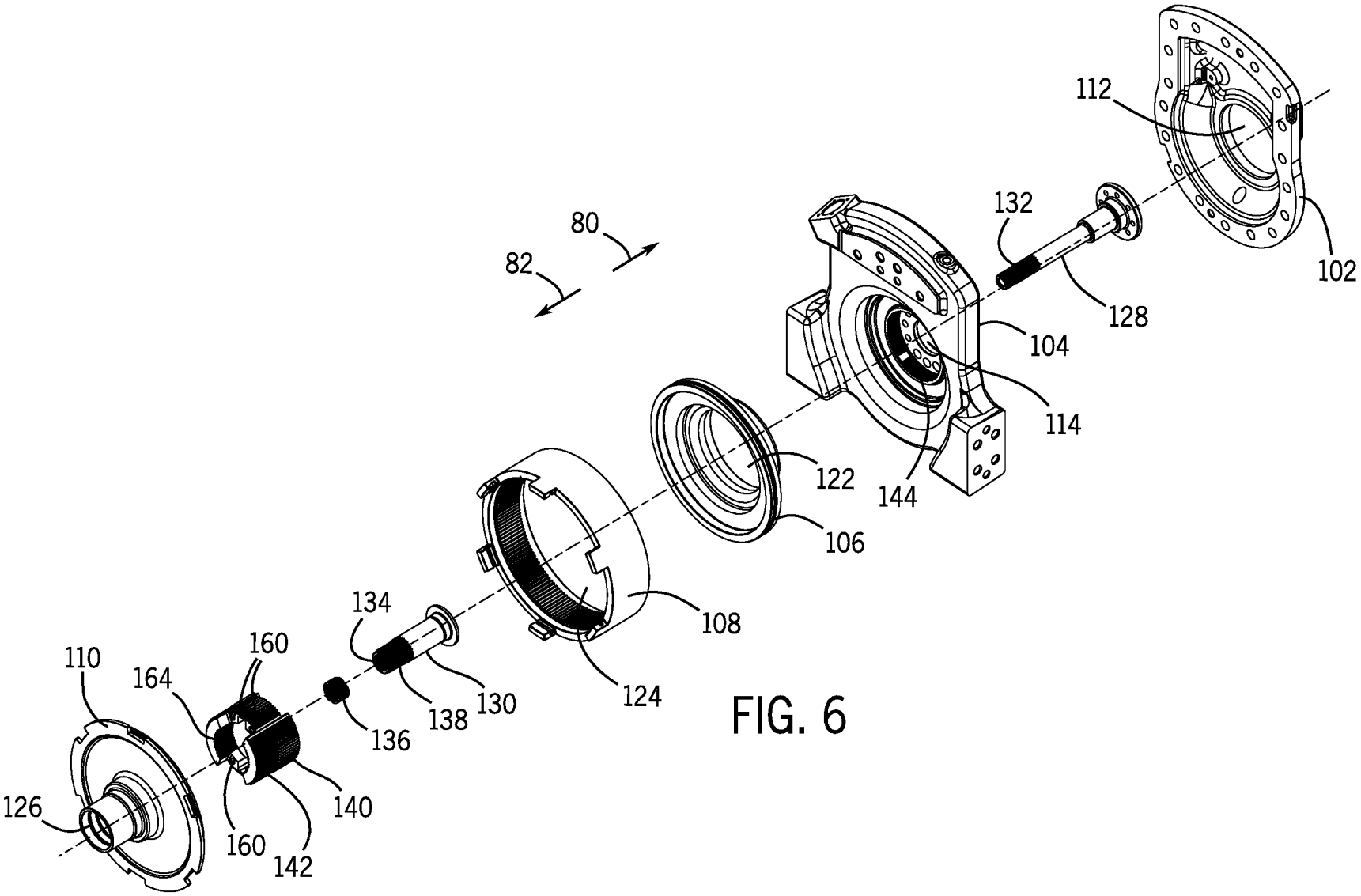
FIG. 6 is an exploded isometric view of a housing arrangement, a stationary hub, an input shaft and a sliding shaft of the power transmission assembly of FIG. 4 for the example starter-generator device.
Figure 7B:
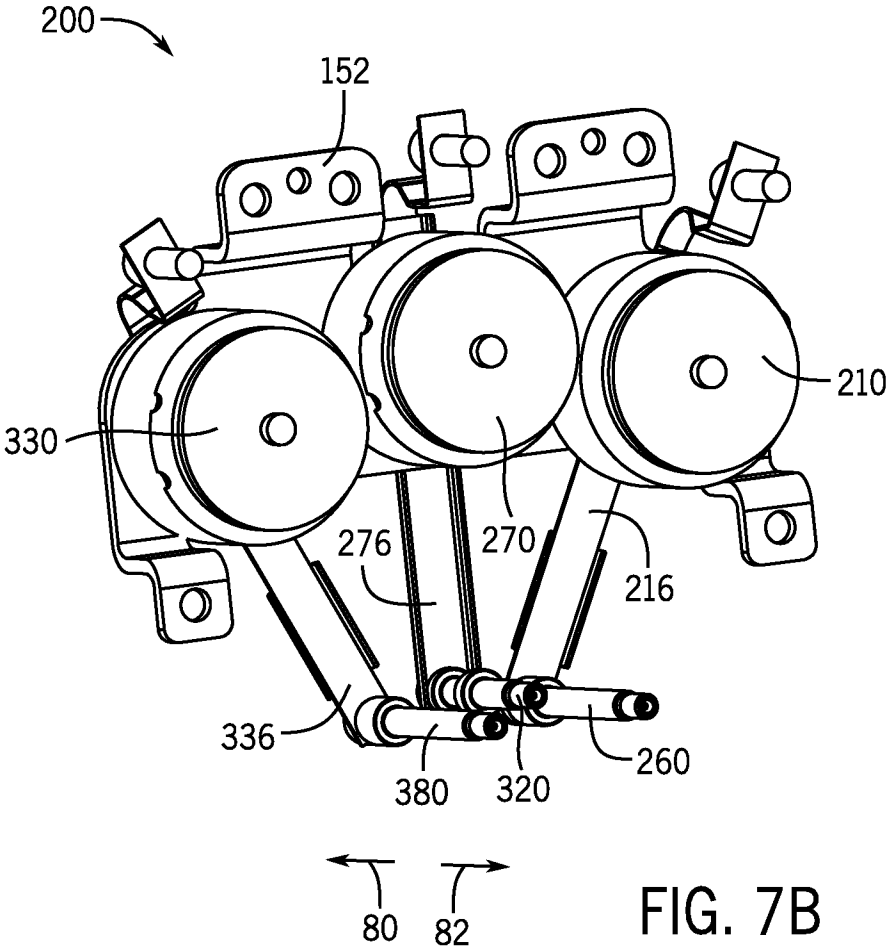
FIGS. 7A and 7B are isolated perspective views of an actuation assembly of the power transmission assembly of FIG. 4 for the example starter-generator device.
Figure 7A:
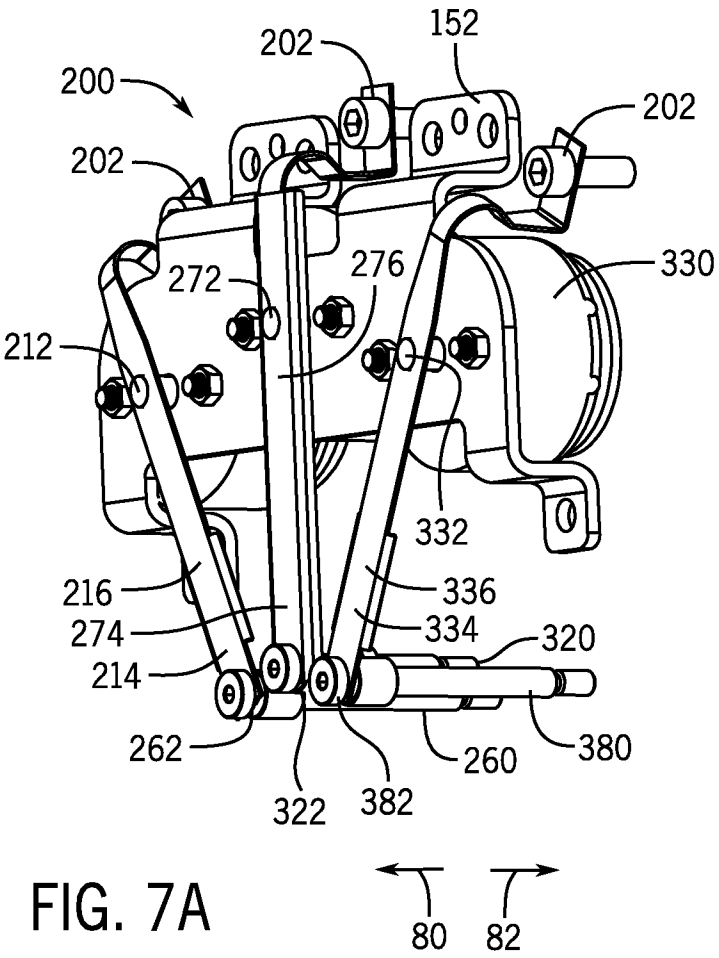

Referring to FIGS. 4-6, in one example, the power transmission assembly 40 includes a housing arrangement 100, an actuation assembly 200, a clutch arrangement 400 and a gear set 500. In general, the gear set 500 operates to transfer torque between the engine 30 and electric machine 42 at predetermined gear ratios that are selected based on the status of the clutch arrangement 400, which is controlled by the actuation apparatus 200 based on signals from the controller 36.

The housing arrangement 100 of the power transmission assembly 40 includes at least one housing element forming a reaction member. For example, the housing arrangement 100 may be formed by a first housing element 102, a second housing element 104, a third housing element 106, a fourth housing element 108 and a fifth housing element 110. The first housing element 102 may function as a cover at an electric machine side and includes a first opening 112 through which a drive axis (i.e., the primary rotational axis 66) extends. The second housing element 104 may function as a base to which the first housing element 102 is secured. The second housing element 104 includes a second opening 114 through which the drive axis 66 extends. The second housing element 104 includes a mounting arrangement 116 formed by one or more side walls 118 that function to mount the power transmission assembly 40 to the engine 30. The first housing element 102 and the second housing element 104 may be considered, collectively or individually, as reaction members that are fixed axially, radially and rotationally with respect to the drive axis.

The third housing element 106 is connected to second housing element 104 and is configured to rotate relative to the second housing element 104, for example, via a rotational bearing assembly. The third housing element 106 includes a third opening 122 through which the drive axis 66 extends. The fourth housing element 108 is rotationally fixed to the third housing element 106 and includes a fourth opening 124 through which the drive axis 66 extends. The fifth housing element 110 is rotationally fixed to the fourth housing element 108 and includes a fifth opening 126 through which the drive axis 66 extends. The fifth housing element 110 may function as a drive plate to facilitate coupling of the power transmission assembly 40 to the engine 30, for example, via the engine crankshaft 46. In some examples, the fifth housing element 110 may operate as a torsional damper to dampen vibrations at the crankshaft 46 of the engine 30 (FIG. 3).

The openings 112, 114, 122, 124, 126 of respective housing elements 102, 104, 106, 108, 110 may be collectively referred to as a central opening of the housing arrangement 100. An input shaft 128 extends through the central opening and is rotatable on the drive axis 66. The input shaft 128 is rotationally coupled to the power transfer element 56 from the pulley 60. The input shaft 128 is in turn coupled to the gear set 500 (FIG. 17) such that rotational speed and torque may be transmitted through the power transmission assembly 40. The central opening may accommodate the coupling between the power transfer element 56 and the input shaft 128 into the power transmission assembly 40. In some examples, the power transfer element 56 and the input shaft 128 are a single unitary part. The central opening in the housing arrangement 100 may also accommodate various connections between the actuation assembly 200 and the clutch arrangement 400.

In one example, the input shaft 128 is coupled to the gear set 500 via a sliding shaft 130. The sliding shaft 130 is rotationally fixed to the input shaft 128 such that the input shaft 128 and the sliding shaft 130 rotate together. In one example, the input shaft 128 is rotationally fixed to the sliding shaft 130 by engagement of outer splines 132 on the input shaft 128 with inner splines 134 on the sliding shaft 130. The sliding shaft 130 is also configured for axial movement relative to the input shaft 128 in the first and second axial directions 80, 82. In one example, the sliding shaft 130 is urged to move in the second axial direction 82 by a biasing element 136 interposed between the input shaft 128 and the sliding shaft 130. The sliding shaft 130 may be moved in the first axial direction 80 against a biasing force of the biasing element 136. The sliding shaft 130 further includes outer splines 138 configured to engage a correspondingly splined or toothed portion of the gear set 500 to transmit rotation to the gear set 500.

With further reference to FIG. 6, a stationary hub 140 is rotationally fixed to the housing arrangement 100. In one example, the stationary hub 140 is rotationally fixed to the second housing element 104, for instance, by engagement of outer hub splines 142 with inner housing splines 144.

The actuation assembly 200 is operable to reposition one or more portions (i.e., clutches) of the clutch arrangement 400. The actuation assembly 200 generally includes an actuator device and a linkage assembly. The actuator device is energized to power movement of an armature in one direction (e.g., the first or second axial direction). The linkage assembly includes a linkage made from a material that is flexible within the elastic limit, i.e., a resilient, elastically deformable material, configured to be elastically deformed in response to application of an external force and to return to an undeformed condition under an elastic return force in the response to removal of the external force. The linkage is installed in the housing arrangement in an undeformed, unloaded condition and thus, is not pretensioned for installation.

The armature, in response to the actuator device being energized, applies a push force to the linkage in the direction of the powered movement. The push force causes the linkage to elastically deform such that an inner (distal) end of the linkage is displaced in one of the first and second axial directions to effect repositioning of a clutch portion. Elastic deformation of the linkage causes the linkage to apply an elastic return force to the armature in a direction opposite to the push force. Thus, the linkage is moved to a deformed, loaded condition by powered movement of the armature. The actuator device may remain energized to maintain the push force on the linkage, and in turn, maintain the linkage in the deformed, loaded condition. In general, the linkage acts as a lever to cause axial movement of the clutch portion in response to the actuator device being energized.

The linkage is urged to the undeformed, unloaded condition under the elastic return force. In response to the actuator device being deenergized, the push force is removed from the linkage and the linkage returns to the undeformed, unloaded condition under the elastic return force such that the inner (distal) end is moved in the other of the first and second axial directions (i.e., a direction opposite to the direction of displacement under powered movement of the armature). In addition, the linkage, during return movement, applies the elastic return force to the armature to move the armature in a direction opposite to the direction of the powered movement. Thus, the linkage generally acts as a return spring in response to the actuator device being deenergized.

Referring now to FIGS. 5, 7A, 7B, 8 and 9, in the illustrated example, the actuation assembly 200 includes a first (or low) actuator device 210, a second (or high) actuator device 270, and a third (or mid) actuator device 330. The first, second and third actuator devices 210, 270, 330 are supported on one side (e.g., the electric machine side) of the second housing element 104. The second housing element 104 constitutes a reaction member and includes, on the one side, first, second, and third recesses 146, 148, 150 (FIG. 5) for supporting the respective actuator devices 210, 270, 330. In some examples, the actuator devices 210, 270, 330 are secured between the second housing element 104 and a mounting bracket 152.

Each actuator device 210, 270, 330 includes an armature 212, 272, 332 (also referred to as a first armature 212, a second armature 272 and a third armature 332) configured for powered movement in the first axial direction 80 in response to the corresponding actuator device 210, 270, 330 being energized. The actuator devices 210, 270, 330 remain energized to maintain the armatures 212, 272, 332 extended in the first axial direction 80. In addition, each actuator device 210, 270, 330 includes at least one connection element (not shown) that enables commands and/or power between the respective actuator device 210, 270, 330, the controller 36 (FIG. 1), and/or other sources. The connection elements may be wired or wireless connections. Positioning the first, second, and third actuator devices 210, 270, 330 around the outer perimeter of the second housing element 104 may facilitate wire routing, if applicable, between the controller 36 and the connection elements.

The actuator devices 210, 270, 330 may be electromechanical solenoid devices. It will be appreciated, however, that other examples may have different numbers or types of actuator devices (e.g., linear actuators). The electromagnetic solenoids generate linear movement of respective armatures in the first axial direction 80 by manipulating an induced magnetic field. The actuator devices 210, 270, 330 are relatively low-profile devices that enable a smaller overall package. In one example, the first, second and third actuator devices 210, 270, 330 are identical.

In the illustrated embodiments, the actuator devices 210, 270, 330 are mounted on one side only of the second housing element 104 and act in one axial direction only (i.e., the first axial direction 80) via powered armature movements. Thus, the actuator devices 210, 270, 330 operate as push-only actuator devices. This arrangement allows for consistent orientation and simplified assembly of the actuation assembly 200.

With continued reference to FIGS. 7A and 7B, 8 and 9, and further reference to FIGS. 10A-10E and FIGS. 11A-11E, the actuation assembly 200 includes first, second and third linkage assemblies 214, 274, 334 coupled to respective actuator devices 210, 270, 330. The linkage assemblies 214, 274, 334 include a first, second and third linkage 216, 276, 336, respectively. Each linkage 216, 276, 336 has a first (outer) end 218, 278, 338 proximal to second housing element 104 and a second (inner) end 220, 280, 340 distal from the second housing element 104. In general, each linkage 216, 276, 336 includes a first portion 222, 282, 342 having a mounting region 224, 284, 344 and a neck region 226, 286, 346. The mounting region 224, 284, 344 is configured to receive a bolt 202 for mounting the linkage 216, 276, 336 to the second housing element 104. The neck region 226, 286, 346 may be formed as a permanent bend having a bend radius 228, 288, 348. In one example, the permanent bend is substantially arc-shaped and forms a semi-circle, such that a first segment of the permanent bend extends axially away from the mounting region 224, 284, 344 and radially away from the drive axis 66, and a second segment extends axially away from the first segment and radially toward the drive axis 66. The first portion 222, 282, 342 of each linkage 216, 276, 336 extends away from a face of the second housing element 104 in the first axial direction over an axial distance 204.

The neck region 226, 286, 346 has a reduced width relative to other portions of the linkage 216, 276, 336. For example, the mounting region 224, 284, 344 has a first width 230, 290, 350 and the neck region 226, 286, 346 has a second width 232, 292, 352 less than the first width 230, 290, 350. In some examples, the first portion 222, 282, 342 may include a first transition region 234, 294, 354 disposed between the mounting region 224, 284, 344 and the neck region 226, 286, 346 having a width transitioning from the first width 230, 290, 350 proximal to the mounting region 224, 284, 344 to the second width 232, 292, 352 proximal to the neck region 226, 286, 346.

Figure 8:
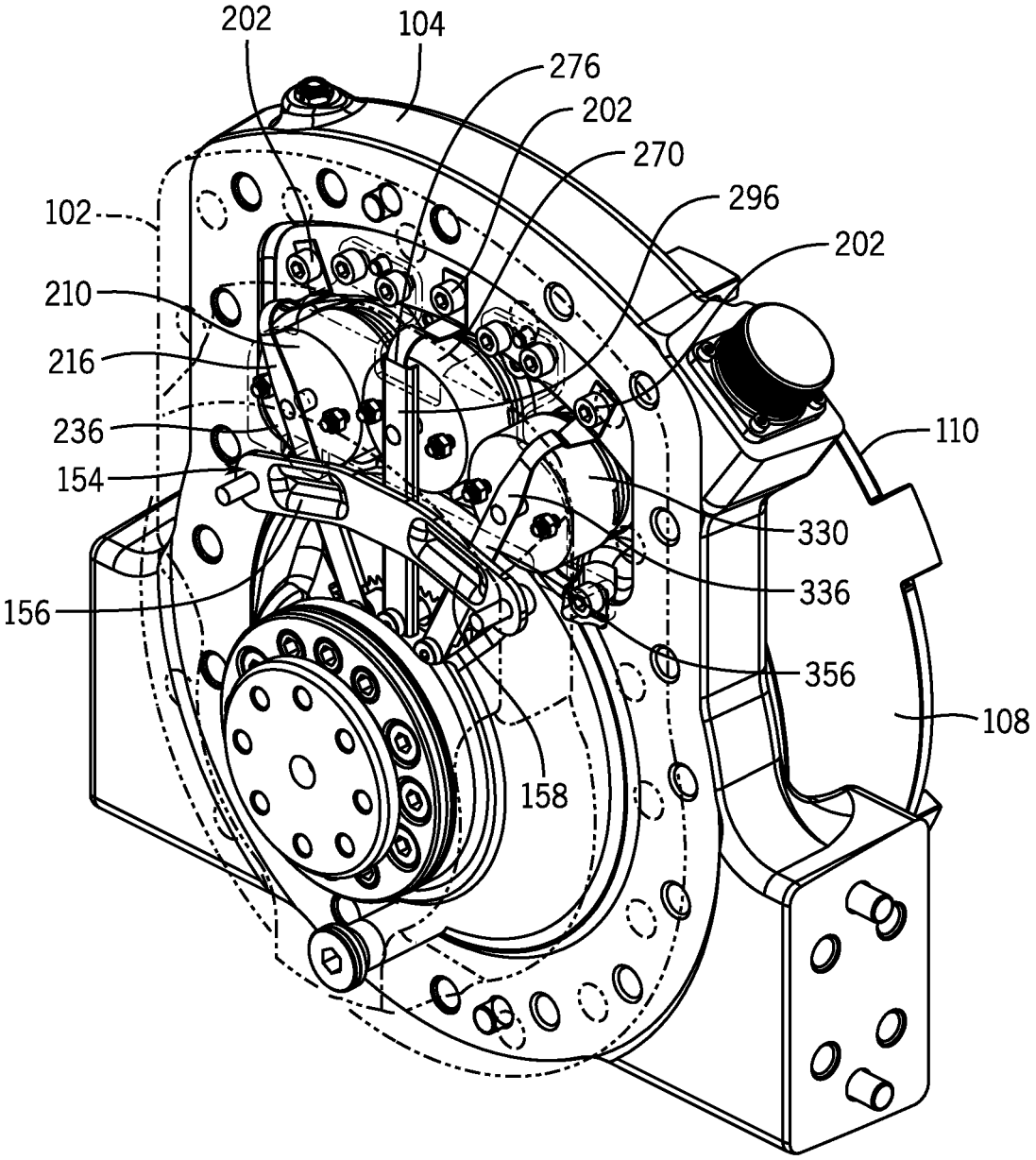
FIG. 8 is a partial isometric view of portions of an actuation assembly of the power transmission assembly of FIG. 4 for the example starter-generator device.
Figure 9:
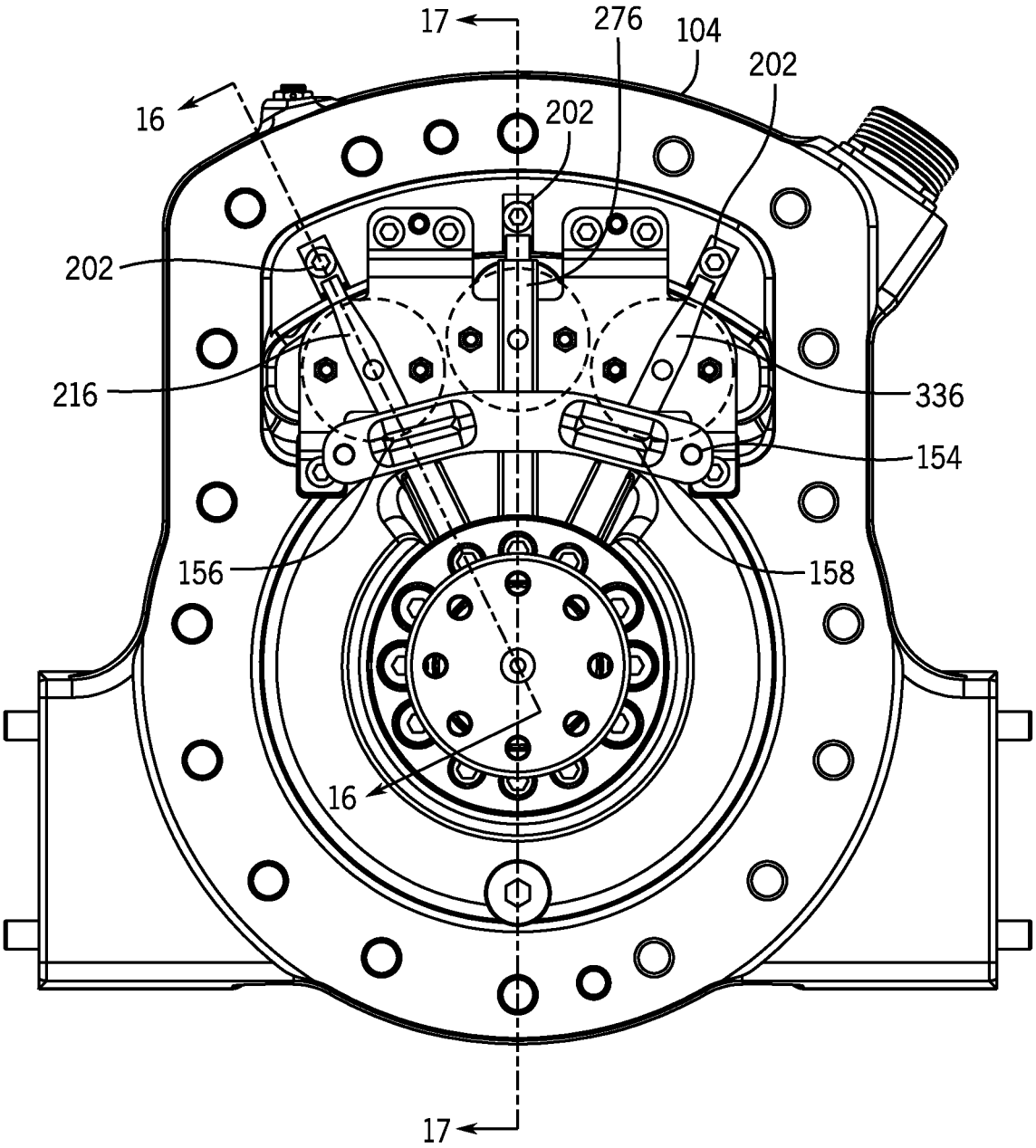
FIG. 9 is a partial first end view of the actuation assembly of the power transmission assembly of FIG. 8 for the example starter-generator device.
Figure 10A:
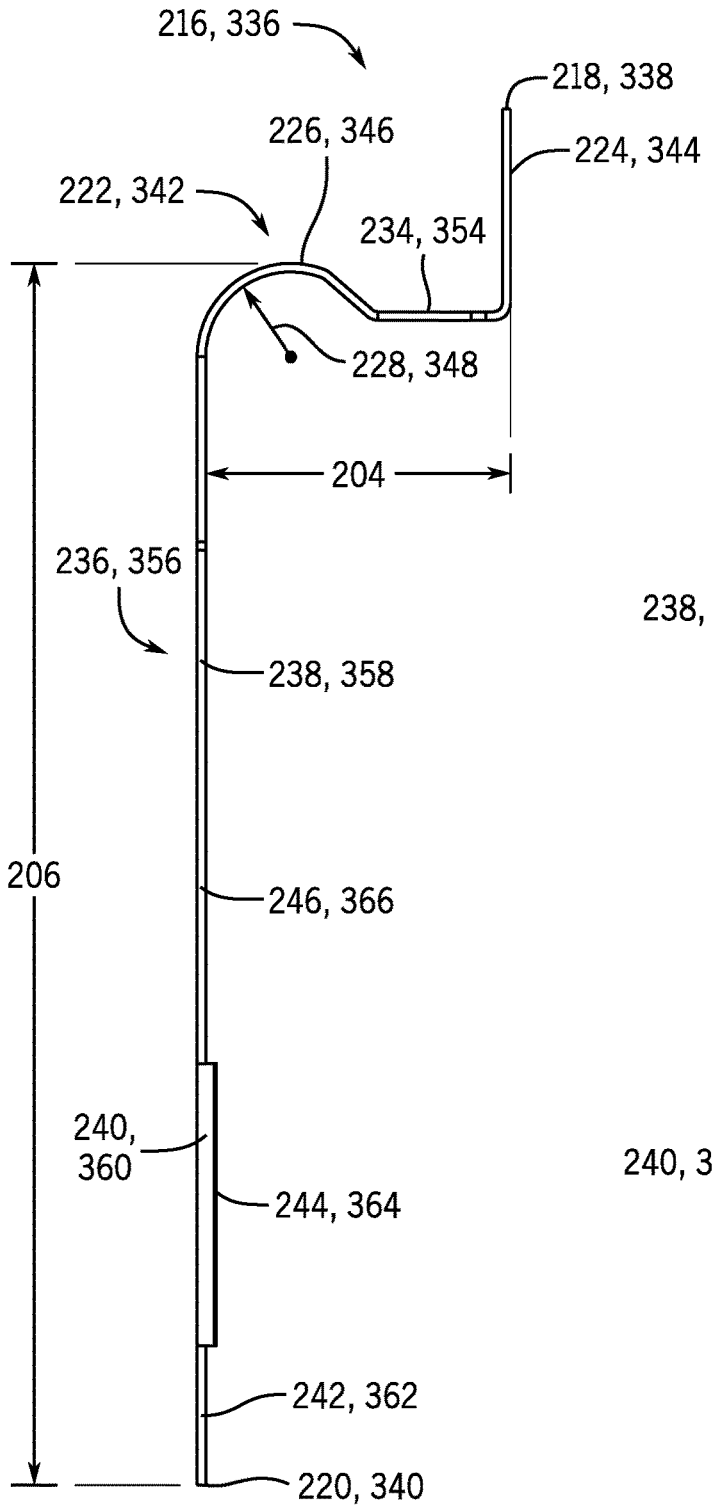
FIGS. 10A-10D are isolated side, front, first isometric, and second isometric views of first and third linkages of the actuation assembly of FIGS. 7A and 7B for the example starter-generator device.
Figure 10B:
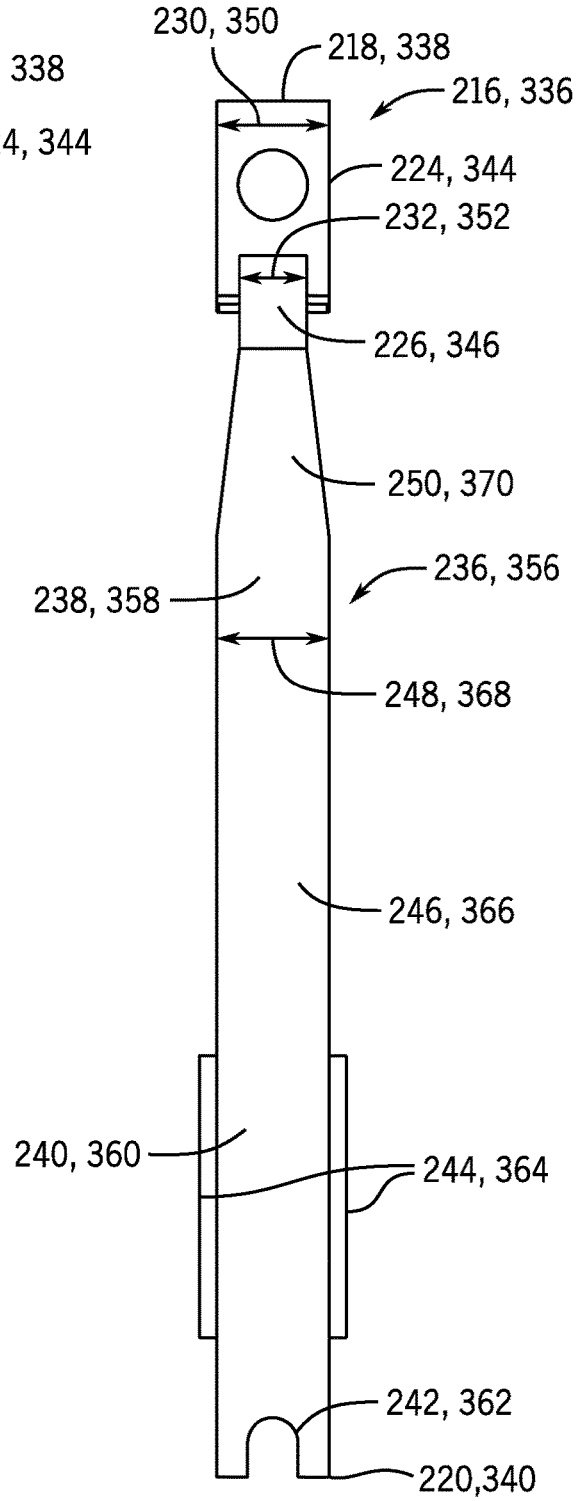
Figures 10C, 10D:
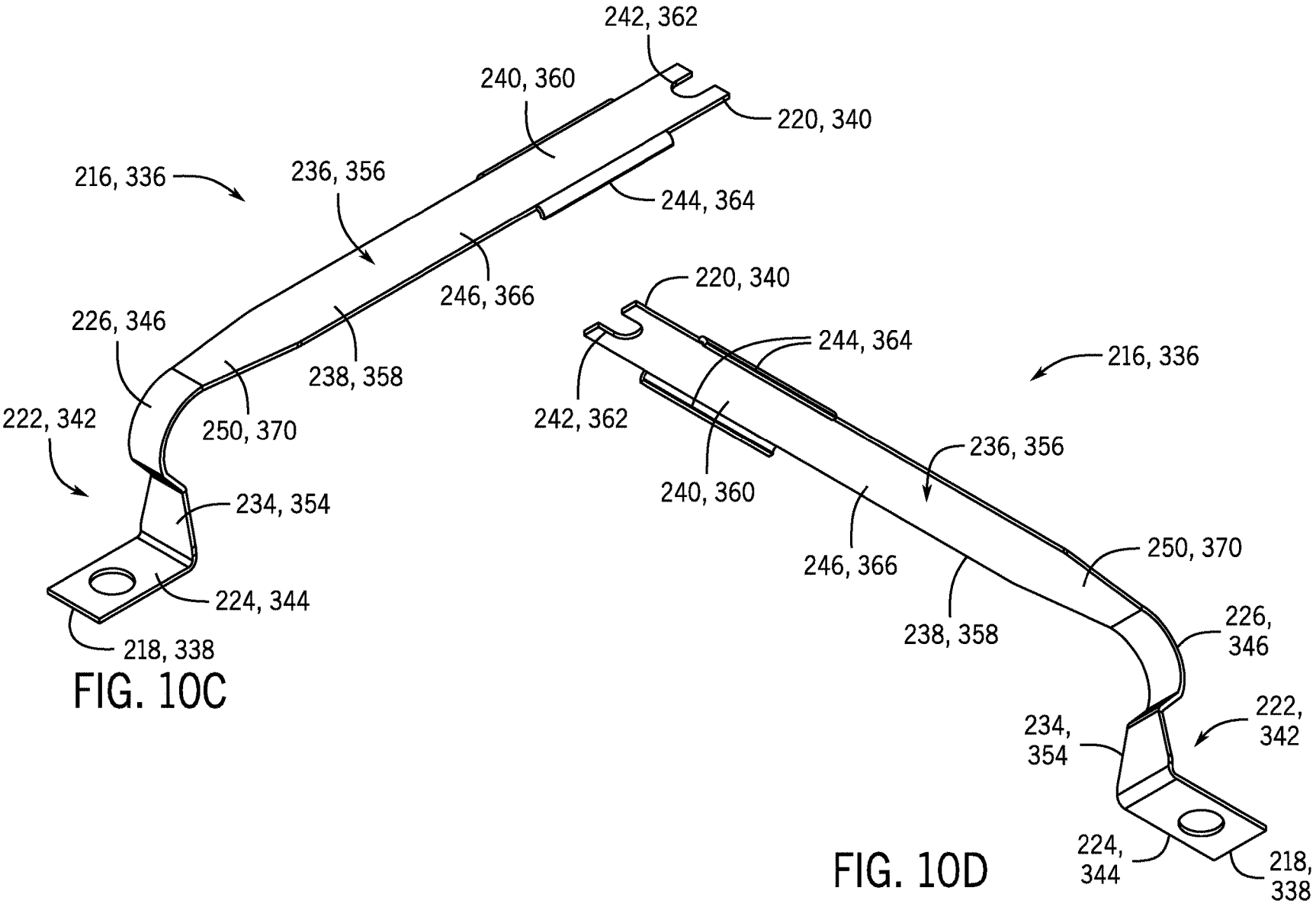
Figure 10E:
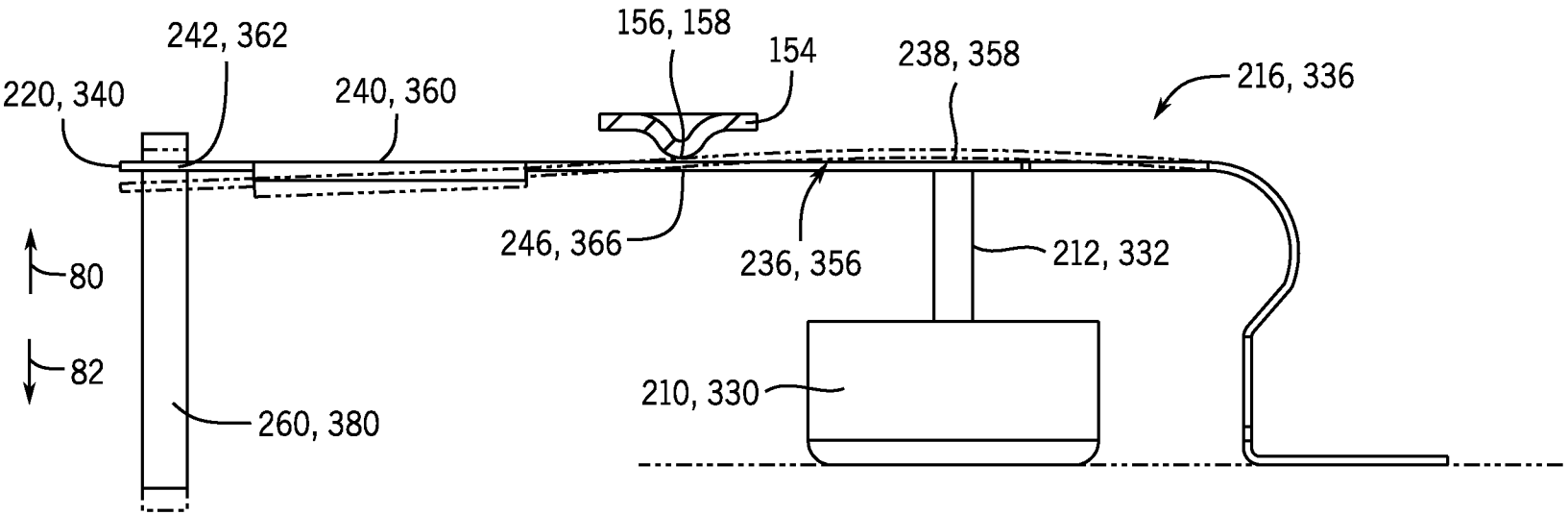
FIG. 10E is a schematic representation depicting actuation of the first and third linkages of the actuation assembly of FIGS. 7A and 7B for the example starter-generator device.
Figure 11A:
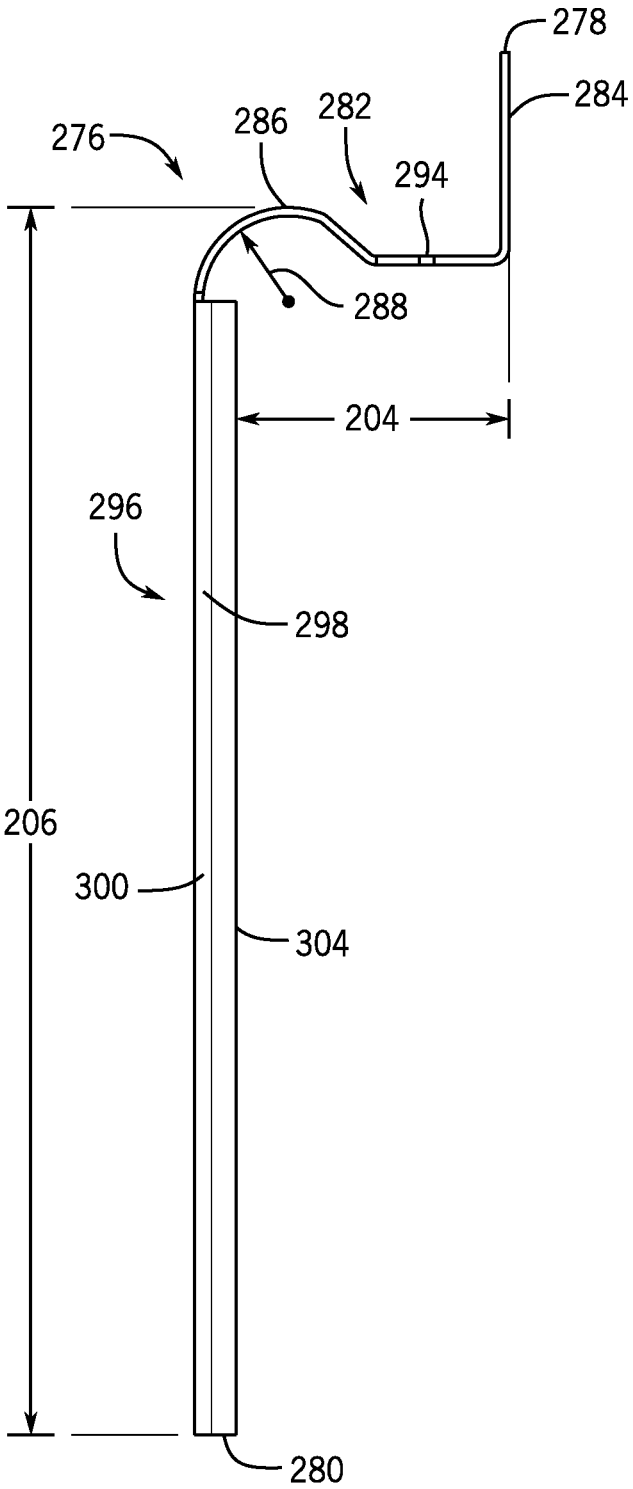
FIGS. 11A-11D are isolated side, front, first isometric, and second isometric views of the second linkage of the actuation assembly of FIGS. 7A and 7B for the example starter-generator device.
Figure 11B:
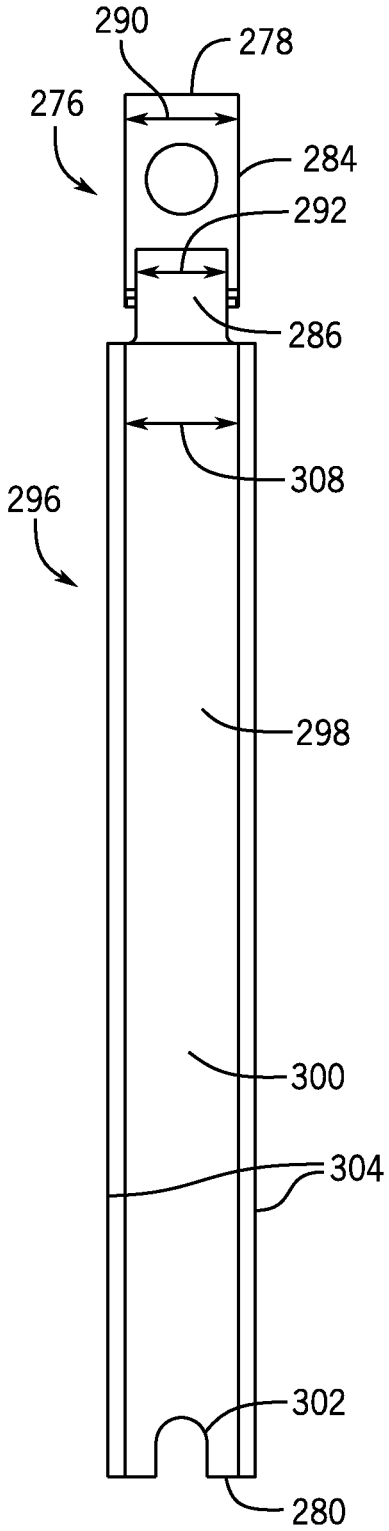
Figure 11D:
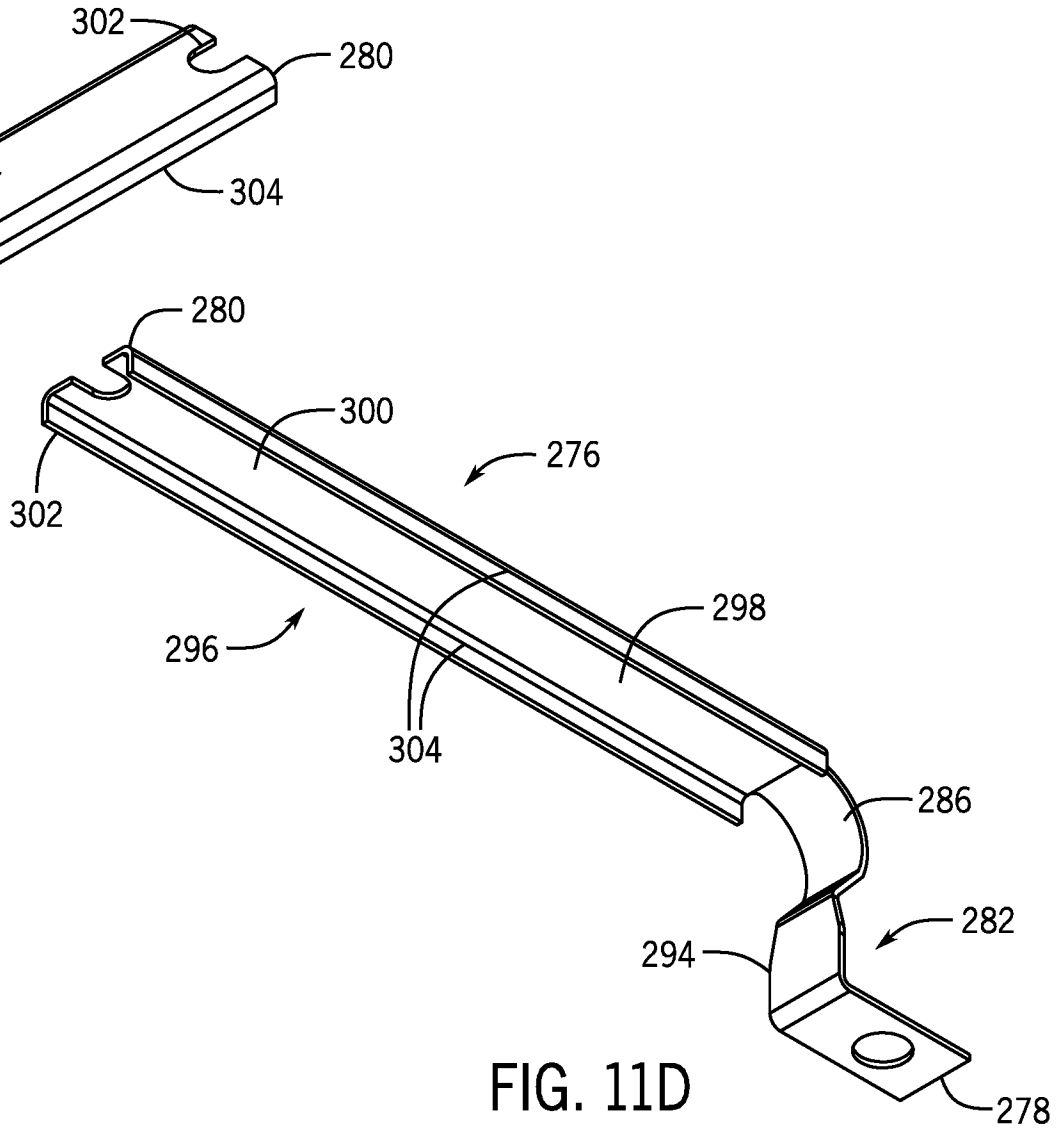
Figure 11C:
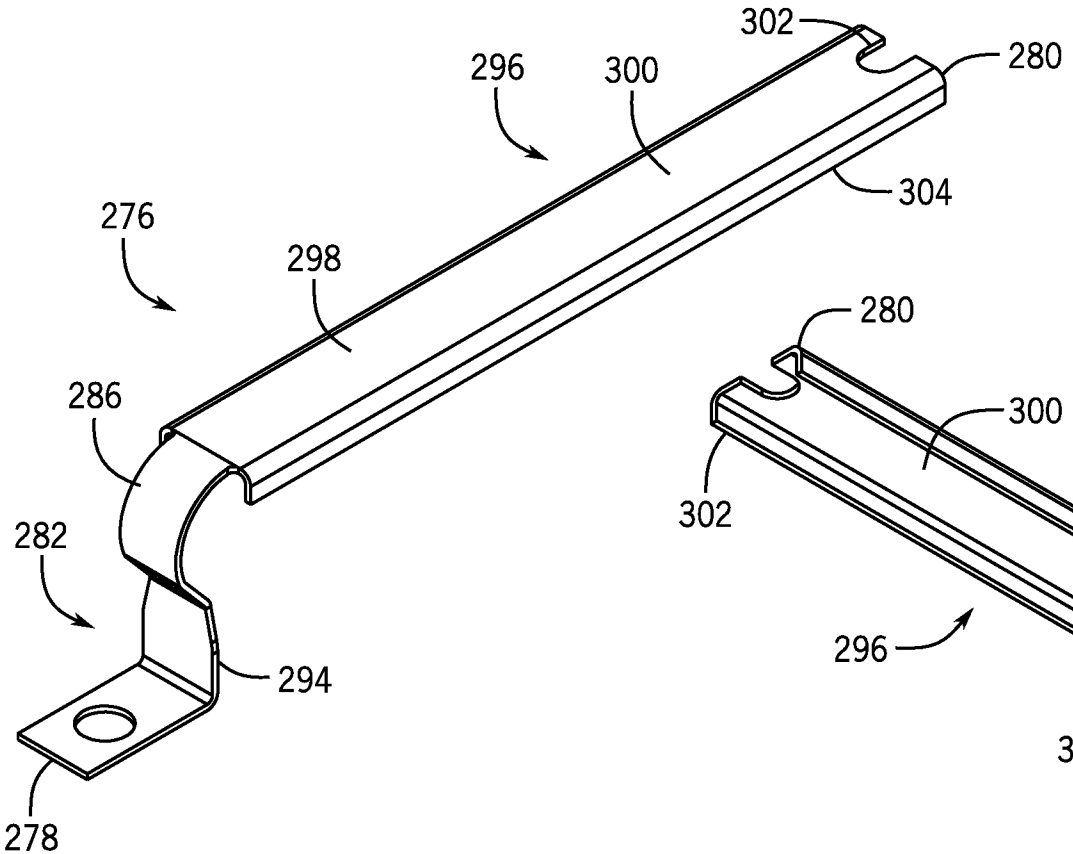
Figure 11E:
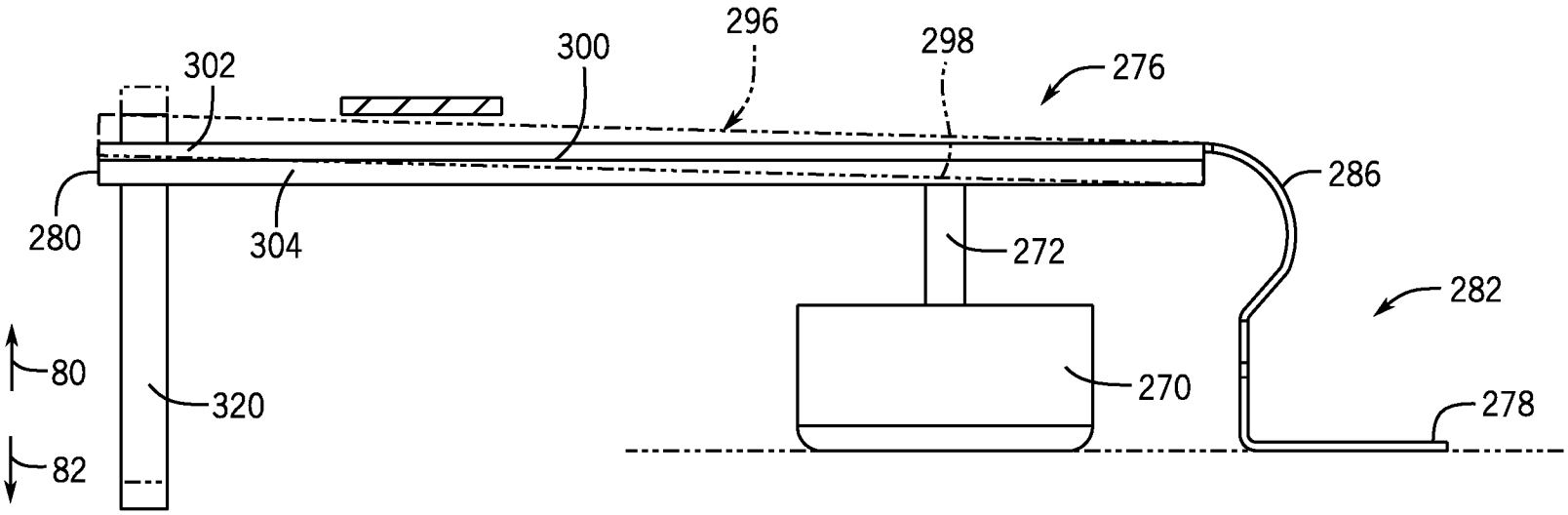
FIG. 11E is a schematic representation depicting actuation of the second linkage of the actuation assembly of FIGS. 7A and 7B for the example starter-generator device.

Each linkage 216, 276, 336 further includes a second portion 236, 296, 356 extending from the first portion 222, 282, 342, for example, from the neck region 226, 286, 346 to the second end 220, 280, 340. As shown in FIGS. 8 and 9, the second portions 236, 296, 356 extend generally in a radial direction inward from respective neck regions 226, 286, 346. A coupling region 238, 298, 358, a stiffened region 240, 300, 360 and a connecting region 242, 302, 362 are arranged along a length of the second portion 236, 296, 356. The coupling region 238, 298, 358 is coupled to a corresponding armature 212, 272, 332 such that the corresponding armature 212, 272, 332 applies the push force to the linkage 216, 276, 336 at the coupling region 238, 298, 358.

The stiffened region 240, 300, 360 may include one or more flanges 244, 304, 364 to increase the stiffness of the second portion 236, 296, 356 relative to adjacent portions of the linkage 216, 276, 336 that do not include flanges or similar stiffening arrangements. In the illustrated example, the flanges 244, 304, 364 are spaced apart on the linkages 216, 276, 336 such that the stiffened region 240, 300, 360 has a substantially C-shaped or channel-shaped cross-section. Accordingly, the stiffened region 240, 300, 360 is configured to resist deformation to reduce or minimize power loss through the linkages 216, 276, 336. It will be appreciated that the present disclosure is not limited to this arrangement, and that other stiffening arrangements may be suitable as well. The stiffened regions 240, 360 of the first and third linkages 216, 336 are spaced from the respective coupling regions 238, 358. The stiffened region 300 of the second linkage 276 includes the corresponding coupling region 298. That is, the coupling region 298 of the second linkage 276 is arranged at a position along the stiffened region 300.

The connecting region 242, 302, 362 is arranged at the second end 220, 280, 340. The connecting region 242, 302, 362 is formed as, or includes, a suitable fastening arrangement configured for complementary engagement, either directly or indirectly, with a portion of the clutch arrangement 400 such that movement of the linkages 216, 276, 336 effects movement of corresponding clutch portions.

In some examples, the first and third linkages 216, 336 also include a corresponding fulcrum region 246, 366 (also referred to as first and second fulcrum regions 246, 366) on the second portion 236, 356. The fulcrum region 246, 366 is arranged between the coupling regions 238, 358 and the stiffened regions 240, 360. A fulcrum bracket 154 is secured to, or formed integrally as one piece with, the housing arrangement 100, for example, at the first housing element 102. The fulcrum bracket 154 includes fulcrums 156, 158 configured to interact with the fulcrum regions 246, 366 to effect movement of the second ends 220, 340 in the second axial direction 82.

The second portion 236, 296, 356 has a third width 248, 308, 368. In one implementation, the third width 248, 308, 368 is greater than the second width 232, 292, 352. The second portion 236, 356 of the first and third linkage 216, 336 may include a second transition region 250, 370 arranged between the neck region 226, 346 and the coupling region 238, 358. The second transition region 250, 370 may have a variable width, transitioning from the second width 232, 352 proximal to the neck region 226, 346 to the third width 248, 368 at a position along the radial length of the second portion 236, 356 for example, between the coupling region 238, 358 and the neck region 226, 346. Although not depicted in the examples of FIGS. 11A-11E, it will be appreciated that the second portion 296 of the second linkage 276 may optionally include a similarly formed second transition region.

In the illustrated examples, the first, second and third actuator devices 210, 270, 330 are energized to power movement of respective armatures 212, 272, 332 in the first axial direction 80. The armatures 212, 272, 332 apply a push force on the linkages 216, 276, 336 at respective coupling regions 238, 298, 358 in the first axial direction 80. The push force causes respective linkages 216, 276, 336 to elastically deform. For example, the push force may cause elastic deformation of the neck regions 226, 286, 346 such that the corresponding second portions 236, 296, 356, or a section a second portion 236, 296, 356, are deflected at least in the first axial direction 80.

The fulcrum regions 246, 366 of respective first and third linkages 216, 336 are urged in the first axial direction 80 into contact with corresponding fulcrums 156, 158 by the push force. Interactions between the fulcrum regions 246, 366 and the fulcrums 156, 158 cause the second portion 236, 356, from the fulcrum regions 246, 366 to the second ends 220, 340, to deflect in a direction opposite to the direction of the push force. Thus, in this example, the second ends 220, 340 (and connecting regions 242, 362) are displaced in the second axial direction 82 in response to powered movement of the armature 212, 332. The stiffened region 240, 360 extends at least partially between the second ends 220, 340 and the fulcrum regions 246, 366 to substantially avoid or prevent power loss through this section of the linkage 216, 336 by limiting or preventing deformation along this section (i.e., between the fulcrum regions 246, 366 and the second ends 220, 340). Accordingly, the first and third linkages 216, 336 are configured to function as levers to reposition the corresponding clutch portions in the second axial direction 82.

The second portion 296 of the second linkage 376 is deflected at least in the first axial direction 80 with elastic deformation of the neck region 286 in response to the push force. Thus, in this example, the second end 280 is displaced in the first axial direction 80 in response to powered movement of the armature 272. The stiffened region 300, according to at least one example, extends generally between the second end 280 and the neck region 286 along the second portion 296 and functions to substantially avoid or prevent power loss along the second portion 296, for example, by limiting or preventing deformation along the second portion 296. The coupling region 298 may be disposed along the stiffened region 300 such that the second portion 296 resists deformation at a location where the push force is applied. Accordingly, the second linkage 276 is configured to function as a lever to reposition a corresponding clutch portion in the first axial direction 80. Axial displacement of the second ends 220, 280, 340 to reposition corresponding clutch portions in response to powered movement of the armatures 212, 272, 332 interacting with the linkages 216, 276, 336 may be referred to herein as a powered stroke.

The actuator devices 210, 270, 330 may remain energized to maintain the armatures 212, 272, 332 in a powered condition, and in turn, maintain the push force on the linkages 216, 276, 336 to hold the linkages 216, 276, 336 in the elastically deformed, loaded condition. The linkages 216, 276, 336 apply an elastic return force to armatures 212, 272, 332 due to the elastic deformation of the linkage material. Thus, the linkages 216, 276, 336 are urged to return to an undeformed, unloaded configuration under the return force, but are held against such return movement by respective armatures 212, 272, 332 when respective actuator devices 210, 270, 330 are energized.

The actuator devices 210, 270, 330 are deenergized to remove the push force from the linkages 216, 276, 336 thereby allowing return movement of the linkages 216, 276, 336 to the undeformed, unloaded condition under the elastic return force. Accordingly, the elastic return force of the linkages 216, 276, 336, for example, at respective neck regions 226, 286, 346, causes the neck regions 226, 286, 346 to return to the undeformed, unloaded condition, and move at least a section of the second portions 236, 296, 356 and the second ends 220, 280, 340 in a direction opposite to the direction of axial displacement caused in response to powered movement of the armatures 212, 272, 332, i.e., during the powered stroke. Accordingly, the second ends 220, 340 of the first and third linkages 216, 336 are moved in the first axial direction 80 and the second end 280 of the second linkage 276 is moved in the second axial direction 82. In such an arrangement, the first, second and third linkages 216, 276, 336 are configured to function as return springs to reposition corresponding clutch portions under the return force in a direction opposite to the direction of movement resulting from the powered stroke. Axial movement of the second ends 220, 280, 340 to reposition corresponding clutch portions under the return force, with the actuator devices 210, 270, 330 deenergized, may be referred to herein as a return stroke.

In examples herein, elastic deformation of the linkages 216, 276, 336 during the powered stroke and the resulting axial displacement of the second ends 220, 280, 340 to effect repositioning of the clutch, may be accommodated, at least in part, by the flexibility of the neck regions 226, 286, 346. For example, the push force may be applied to the second portion 236, 296, 356 to cause elastic deformation of the neck regions 226, 286, 346 which in turn allows deflection of the second portions 236, 296, 356 and axial displacement of the second ends 220, 280, 340 to reposition corresponding portions of the clutch arrangement 400 in the direction of movement of the corresponding second ends 220, 280, 340. The flexibility of the neck regions 226, 286, 346 may be varied during manufacture by controlling different characteristics. Non-exhaustive examples of such characteristics include the width of the neck regions 226, 286, 346 (i.e., the second width 232, 292, 352), the bend radius 228, 288, 348 and material stiffness at the neck regions 226, 286, 346.

In some implementations, the neck regions 226, 286, 346 are formed having a relatively high flexibility (i.e., a relative low stiffness), for example, by having a second width 232, 292, 352 that is less than widths of the mounting regions 224, 284, 344 and the second portions 236, 296, 356 and by being formed as a permanent bend. Thus, the push force for elastically deforming the neck regions 226, 286, 346, and holding the linkages 216, 276, 336 in the deformed, loaded condition, may be relatively low as well. In this manner, the actuator devices 210, 270, 330 may draw less power, produce less heat and experience lower stress compared to known actuator devices in the same field. In some instances, smaller or lower powered actuator devices may be incorporated. Conversely, the elastically deformed neck regions 226, 286, 346 provide at least some of the elastic return force for moving respective linkages to 216, 276, 336 through the return stroke to the undeformed, unloaded condition. Due to the relatively high flexibility of the neck regions 226, 286, 346, the return force may be relatively low, which may reduce stress in the system. It will be appreciated that other portions of the linkages 216, 276, 336 are configured for elastic deformation as well. For example, sections of the second portions 236, 356 at, near and/or between the coupling regions 238, 358 and the fulcrum regions 246, 366 may elastically deform in response to the powered stroke and return to an undeformed, unloaded condition under an elastic return force in the return stroke.

The linkages 216, 276, 336 are configured such that respective second ends 220, 280, 340 are displaceable over an axial stroke distance suitable for moving corresponding portions of the clutch arrangement 400 from a disengaged position decoupled from the gear set 500 to an engaged position coupled to the gear set 500 and from the engaged position to the disengaged position. To this end, the first portions 222, 282, 342 of respective linkages 216, 276, 336 extend over the axial distance 204 such that the second portions 236, 296, 356 and second ends 220, 280, 340 have adequate clearance to move through the axial stroke distance. Other characteristics may be controlled during manufacture which vary the flexibility or stiffness of the linkages 216, 276, 336, which in turn varies the axial displacement of the second ends 220, 260, 280 for selected push force. Such characteristics include, but are not limited to, the bend radius 228, 288, 348 of the neck regions 226, 286, 346, the length 206 of the linkages 216, 276, 336, relative widths of different regions or portions (e.g., the first width 230, 290, 350, the second width 232, 292, 352, and the third width 248, 308, 368), material properties (e.g., elastic properties) and/or geometry of the linkages 216, 276, 336 (e.g., the arrangement of flanges 244, 304, 364 for stiffening a region).

Referring again to FIGS. 7A, 7B, 10E, 11E and 12-15, the linkages 216, 276, 336 are connected to the respective portions of the clutch arrangement 400 by respective first, second and third actuation pins 260, 320, 380. The actuation pins 260, 320, 380 are connected to the connecting regions 242, 302, 362, for example, by a complementary fastening arrangement. In one example, the actuation pins 260, 320, 380 each include a waist portion 262, 322, 382 having a reduced width or diameter, and the connecting regions 242, 302, 362 are formed as prongs or forks configured to receive respective waist portions 262, 322, 382 such that axial movement of the second ends 220, 280, 340 (including connecting region 242, 302, 362) effects corresponding axial movement of the actuation pins 260, 320, 380. It will be appreciated that other suitable fastening arrangements, or combinations of fastening arrangements, may be implemented and that the present description is not limited to the depicted example. For instance, the actuation pins 260, 320, 380 may be connected to the connecting regions 242, 302, 362 by a complementary threaded engagement.

Figure 16:
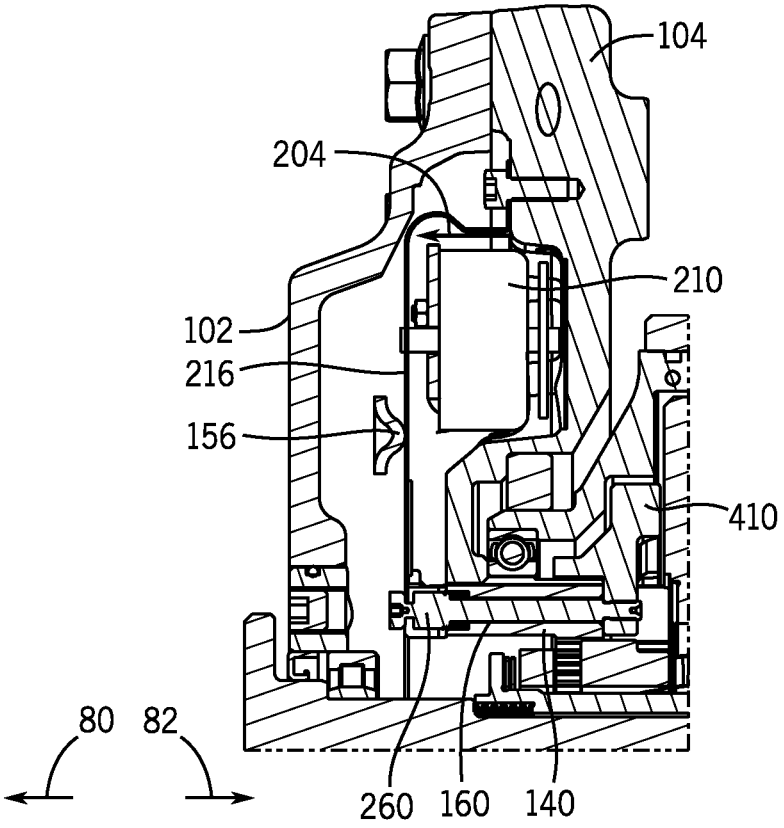
FIG. 16 is a partial side cross-sectional view of the power transmission assembly through line 16-16 of FIG. 9 for the example starter-generator device.
Figure 17:
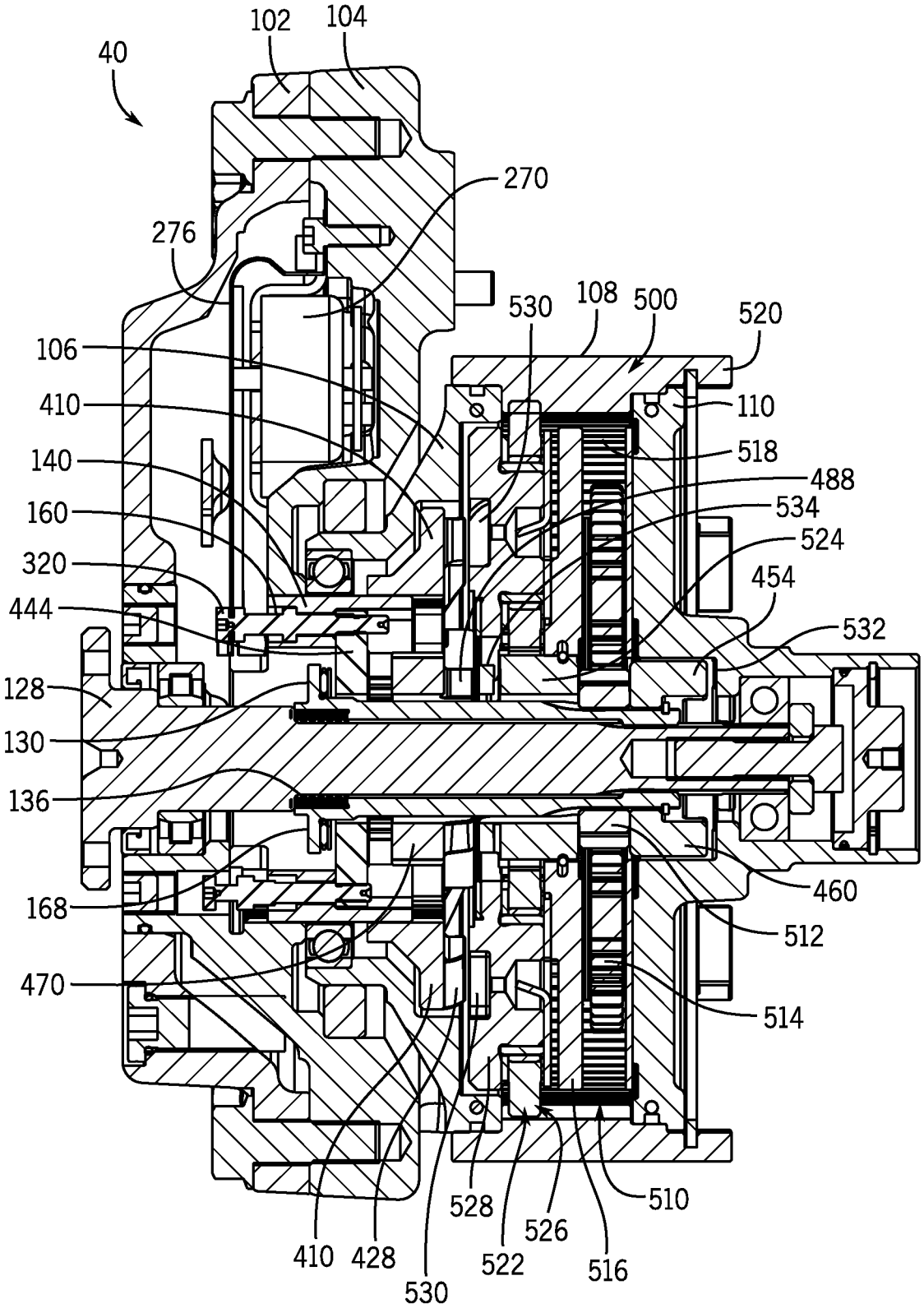
FIG. 17 is a side cross-sectional view of the power transmission assembly through line 17-17 of FIG. 9 for the example starter-generator device.

As shown in FIGS. 6, 16 and 17, the actuation pins 260, 320, 380 may be supported by the stationary hub 140 between corresponding linkages 216, 276, 336 and portions of the clutch arrangement 400. In the depicted example, the actuation pins 260, 320, 380 extend through respective apertures 160 of the stationary hub 140 and are configured for sliding, axial movement within the apertures 160 in response to movement of the linkages 216, 276, 316.

With reference to FIGS. 12-15, 17 and 18, the clutch arrangement 400 includes one or more portions configured to selectively interact with the gear set 500 to modify power flow within the power transmission assembly 40. In the illustrated example, the one or more portions of the clutch arrangement 400 include a low clutch 410, a high clutch 440 and a mid clutch 470. The low clutch 410 is connected to the first actuator device 210 via the first linkage assembly 214, the high clutch 440 is connected to the second actuator device 270 via the second linkage assembly 274, and the mid clutch 470 is connected to the third actuator 330 via the third linkage assembly 334. The low, high and mid clutches 410, 440, 470 may be considered "shifting" or "dog" clutches.

In the examples above, the actuation pins 260, 320, 380 are described with respect to the corresponding linkage assemblies 214, 274, 334 of the actuation assembly 200. However, it will be appreciated that the actuation pins 260, 320, 380 may alternatively be provided with the clutch arrangement 400. In one such example, the actuation pins 260, 320, 380 may be connected to, or integrally formed as a unitary part of respective portions (i.e., low clutch 410, high clutch 440, mid clutch 470) of the clutch arrangement 400.

In some examples, the low clutch 410, the high clutch 440 and the mid clutch 470 may include or be connected to an additional low actuation pin 412, an additional high actuation pin 442 and an additional mid actuation pin 472, respectively. The additional actuation pins 412, 442, 472 may be engaged by respective additional actuator devices (not shown) of a second actuation assembly (not shown). The second actuation assembly, by way of the additional actuator devices and additional actuation pins 412, 442, 472 may assist the actuation assembly 200 to reposition the clutches 410, 440, 470 by providing an additional force or control to the clutches 410, 440, 470 in a manner similar to the first actuation assembly 200.

Figure 12:
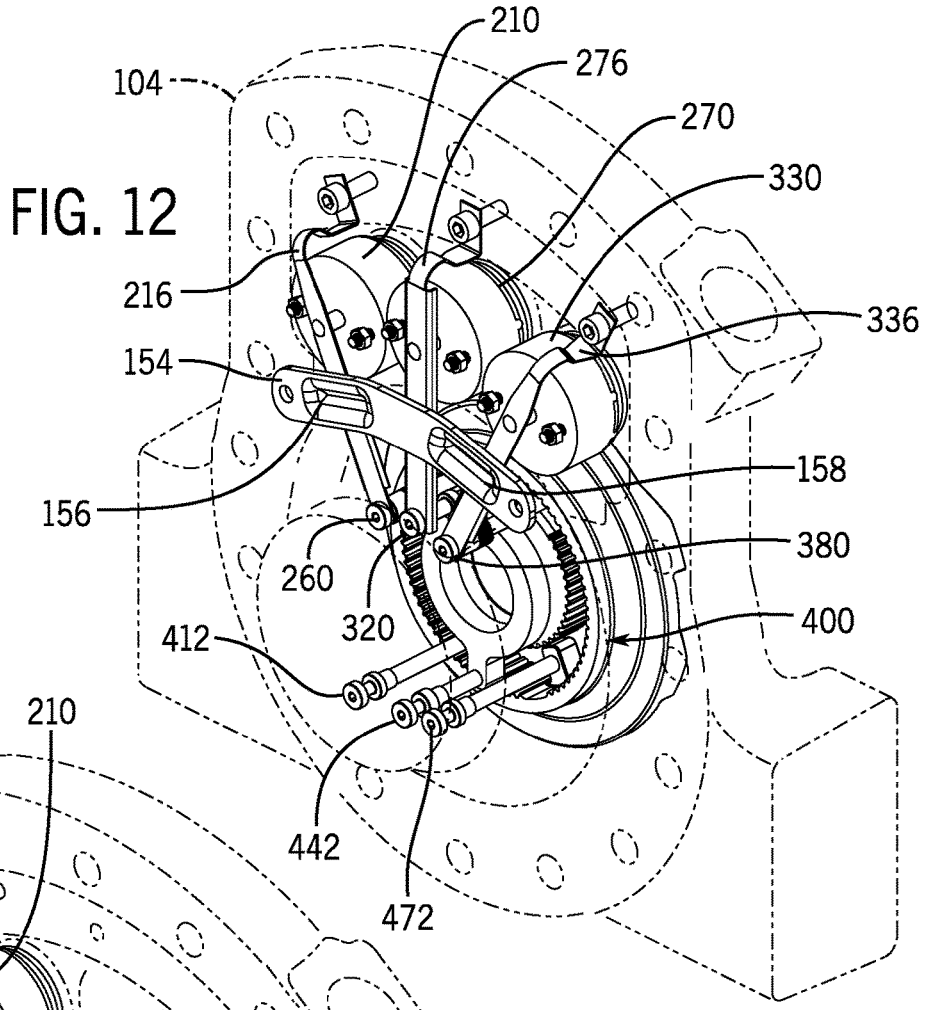
FIG. 12 is an isometric view of the actuation assembly and clutch arrangement removed from the power transmission assembly of FIG. 4 for the example starter-generator device.
Figure 13:
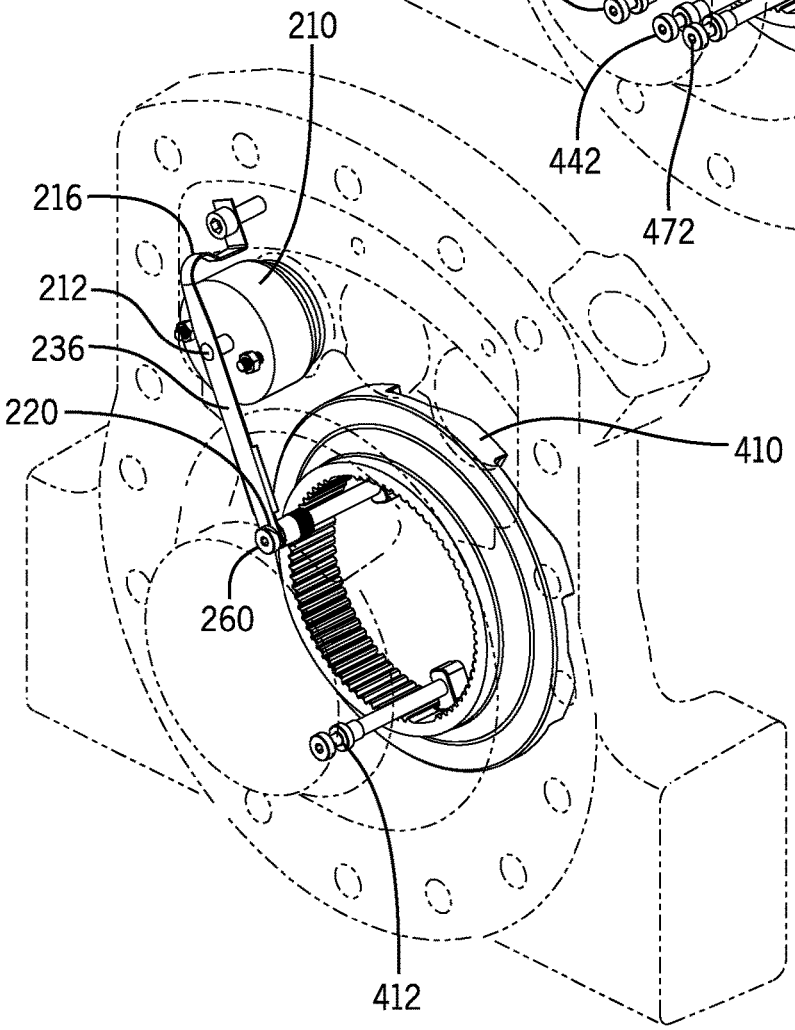
FIG. 13 is an isometric view of a first portion of the actuation assembly and clutch arrangement removed from the power transmission assembly of FIG. 4 for the example starter-generator device.
Figure 18:
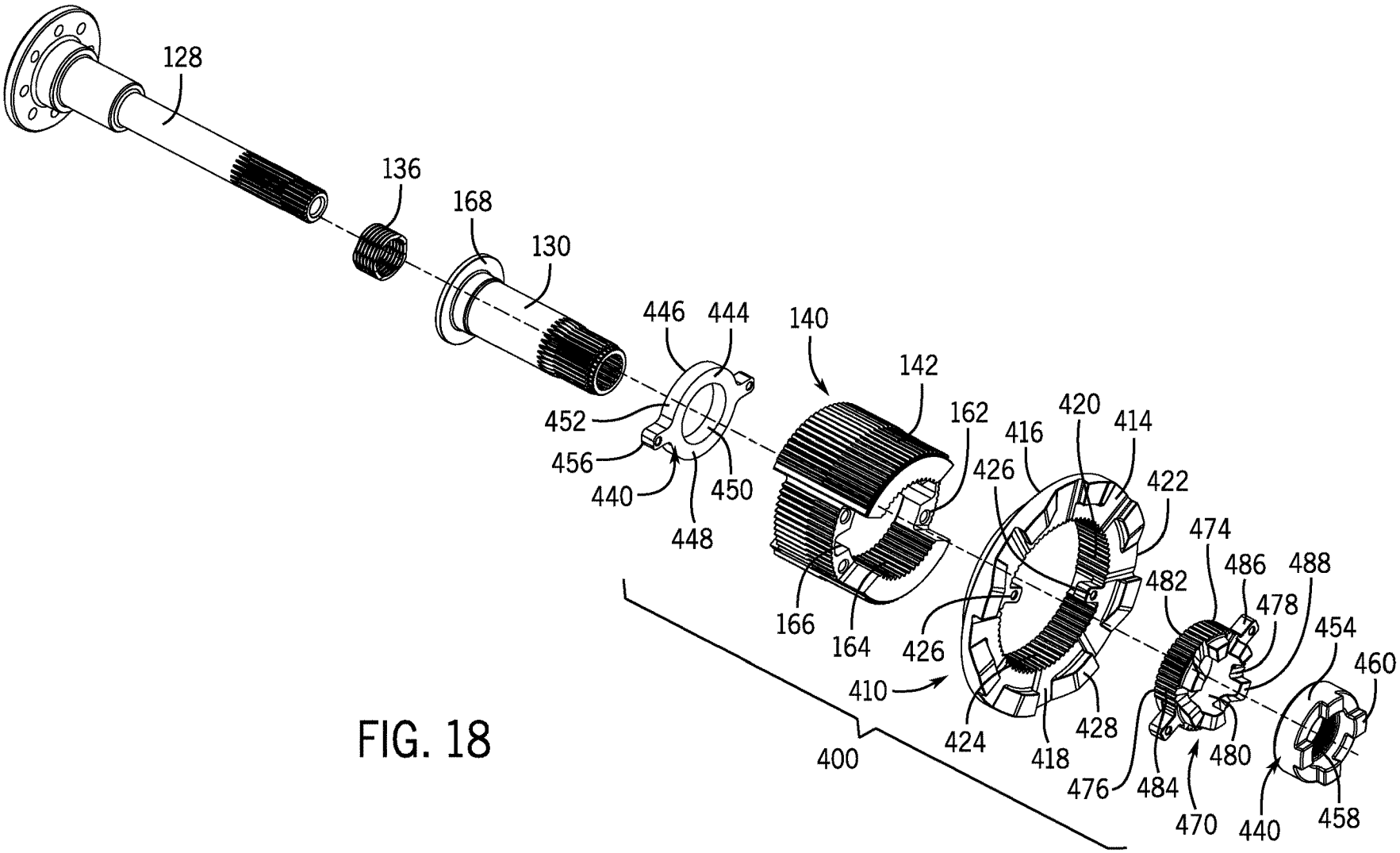
FIG. 18 is an exploded view of the clutch arrangement together with the input shaft, the sliding shaft and the stationary hub of the power transmission assembly of FIG. 4 for the example starter-generator device.

The low clutch 410 is repositionable between an engaged position and a disengaged position relative to the gear set 500. In one example, the low clutch 410 is engaged during a cold engine start mode to enable the electric machine 42 to drive the engine 30 at a first power ratio. Referring to FIGS. 12, 13 and 18, the low clutch 410 is generally ring shaped having a low annular portion 414 with a low first face 416, a low second face 418, a low inner perimeter 420, and a low outer perimeter 422.

The low clutch 410 is mounted on and rotationally fixed to the stationary hub 140. In one example, the low clutch 410 includes low inner splines 424 along the low inner perimeter 420 configured to engage corresponding hub outer splines 142. A set of low tabs 426 is positioned on the low inner perimeter 420 and mount or form the actuation pins 260, 412 such that axial movement of the pins 260, 412 with axial movement of the second end 220 of the first linkage 216 functions to axially reposition the low clutch 410.

The low tabs 426 are positioned in one or more first guide slots 162 of the stationary hub 140 and are configured for axial movement in the first guide slots 162 with repositioning of the low clutch 410. The low clutch 410 additionally includes one or more low clutch engagement elements 428, such as teeth, dogs and the like, extending from the low second face 418 and configured to selectively engage corresponding elements of the gear set 500 in response to axial repositioning of the low clutch 410 in the second axial direction 82. The low clutch engagement elements 428 are configured to selectively disengage the corresponding elements of the gear set 500 in response to axial repositioning of the low clutch 410 in the first axial direction 80.

Accordingly, the first actuator device 210 is energized to effect movement (repositioning) of the low clutch 410 in the second axial direction 82 via the armature 212, the linkage 216 and the actuation pin 260, as well as interaction between the fulcrum region 246 and the fulcrum 156. In this manner, the low clutch engagement elements 428 are moved into engagement with corresponding elements at a portion of the gear set 500.

Conversely, the first actuator device 210 is deenergized to effect movement (repositioning) of the low clutch 410 in the first axial direction 80 under the return force of the first linkage 216. In this manner, the low clutch engagement elements 428 are disengaged from the corresponding elements at a portion of the gear set 500. Thus, in this example, the first actuator device 210 is energized to engage the low clutch 410 with the gear set 500 and deenergized to disengage the low clutch 410 from the gear set 500.

Figure 15:
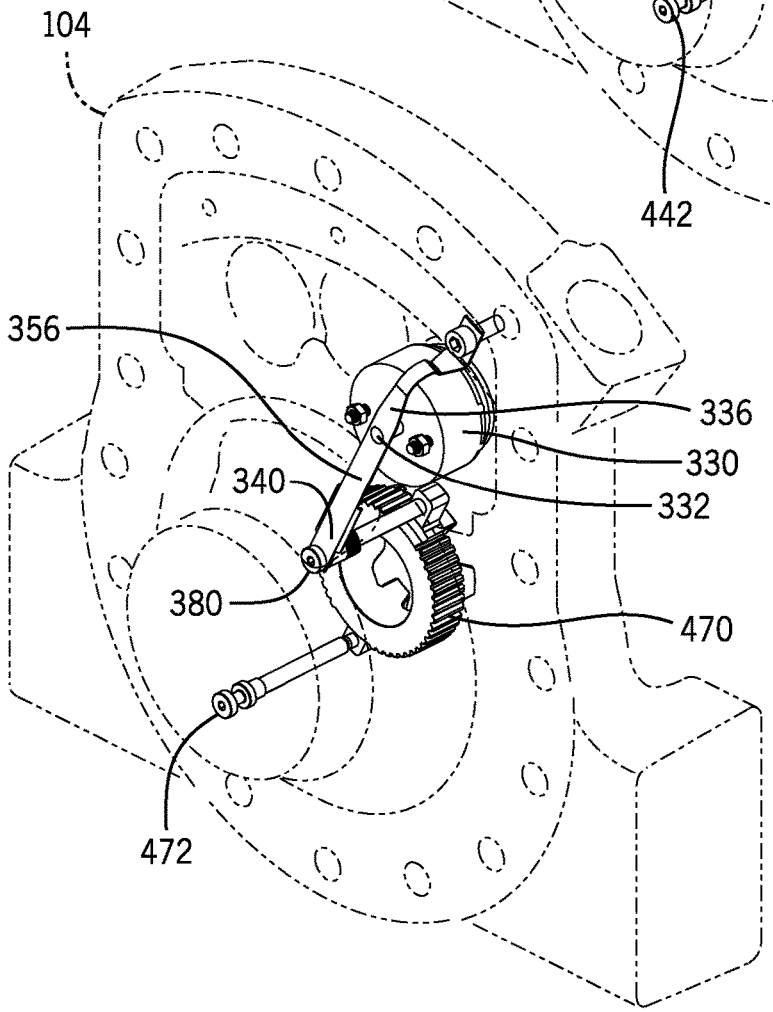
FIG. 15 is an isometric view of a third portion of the actuation assembly and clutch arrangement removed from the power transmission assembly of FIG. 4 for the example starter-generator device.

The mid clutch 470 is repositionable between an engaged position and a disengaged position relative to the gear set 500. In one example, the mid clutch 470 is engaged during a warm engine start mode to enable the electric machine 42 to drive the engine 30 at a second power ratio. Referring to FIGS. 12, 15 and 18, the mid clutch 470 is generally ring shaped having a mid annular portion 474 with a mid first face 476, a mid second face 478, a mid inner perimeter 480, and a mid outer perimeter 482.

The mid clutch 470 is mounted on and rotationally fixed to the stationary hub 140. In one example, the mid clutch 470 includes mid outer splines 484 along the mid outer perimeter 480 configured to engage corresponding hub inner splines 164 of the stationary hub 140. A set of mid tabs 486 is positioned on the mid outer perimeter 480 and mount or form the actuation pins 380, 472 such that axial movement of the pins 380, 472 with axial movement of the second end 340 of the third linkage 336 functions to axially reposition the mid clutch 470.

The mid tabs 486 may be positioned in one or more second guide slots 166 of the stationary hub 140 and are configured for axial movement in the second guide slots 166 with repositioning of the mid clutch 470. The mid clutch 470 additionally includes one or more mid clutch engagement elements 488, such as teeth, dogs and the like, extending from the mid second face 478 and configured to selectively engage corresponding elements of the gear set 500 in response to axial repositioning of the mid clutch 470 in the second axial direction 82. The mid clutch engagement elements 488 are configured to selectively disengage the corresponding elements at a portion of the gear set 500 in response to axial repositioning of the mid clutch 470 in the first axial direction 80.

Accordingly, the third actuator device 330 is energized to effect movement (repositioning) of the mid clutch 470 in the second axial direction 82 via the armature 332, the linkage 336 and the actuation pin 380, as well as interaction between the fulcrum region 366 and the fulcrum 158. In this manner, the mid clutch engagement elements 488 are moved into engagement with corresponding elements at a portion of the gear set 500.

Conversely, the third actuator device 330 is deenergized to effect movement (repositioning) of the mid clutch 470 in the first axial direction 80 under the return force of the third linkage 336. In this manner, the mid clutch engagement elements 488 are disengaged from the corresponding elements at a portion of the gear set 500. Thus, in this example, the third actuator device 330 is energized to engage the mid clutch 470 with the gear set 500 and deenergized to disengage the mid clutch 470 from the gear set 500.

The arrangement of the first linkage assembly 214 and the third linkage assembly 334 enables the first actuator device 210 and third actuator device 330, respectively, to use leverage with the reaction member 104 (i.e., the second housing element) and the fulcrums 156, 158 to facilitate operation in a more compact and efficient manner, for example, by enabling advantageous use of beneficial lever ratios as a function of travel and force.

Figure 14:
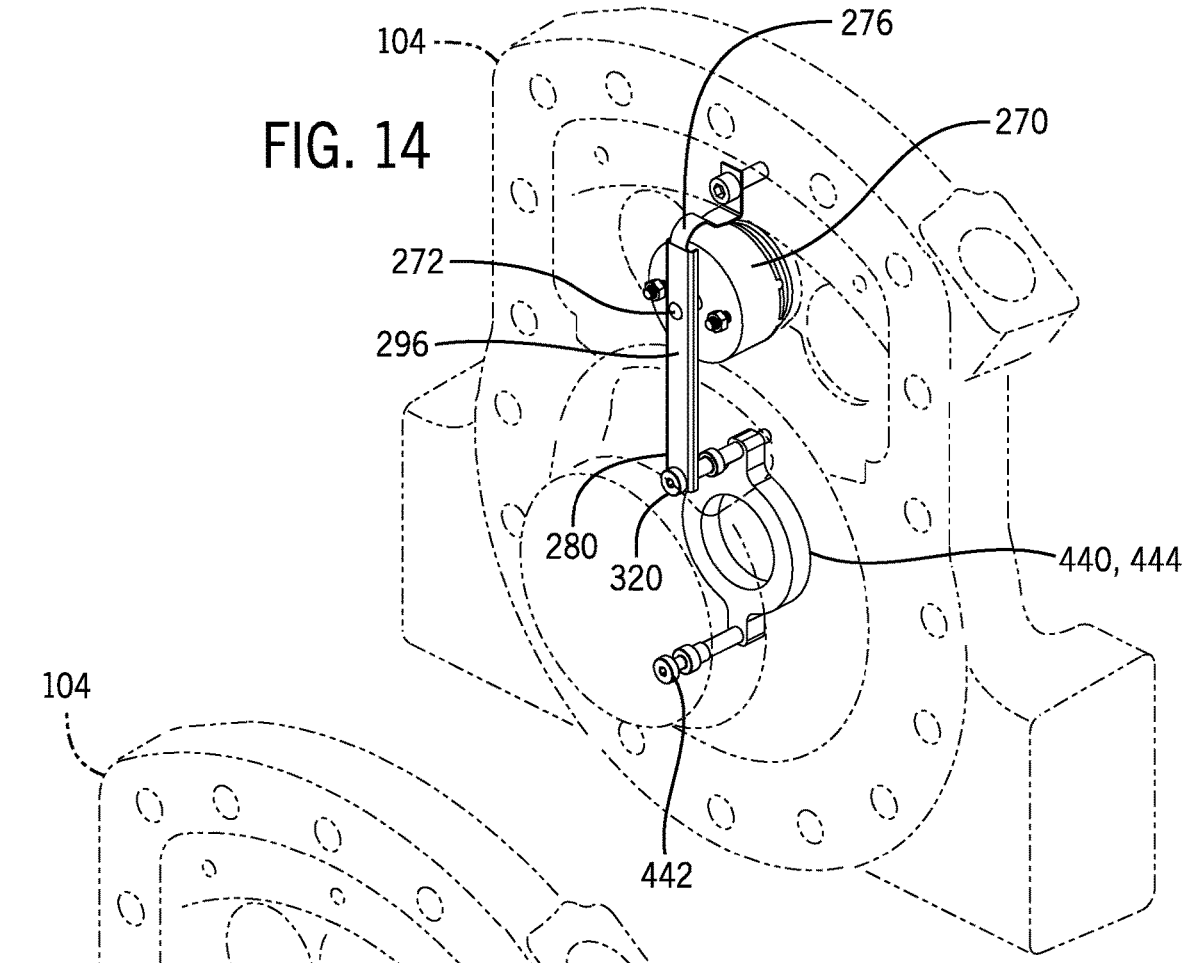
FIG. 14 is an isometric view of a second portion of the actuation assembly and clutch arrangement removed from the power transmission assembly of FIG. 4 for the example starter-generator device.

The high clutch 440 is repositionable between an engaged position and a disengaged position relative to the gear set 500. In one example, the high clutch 440 is engaged during a boost mode to enable the electric machine 42 to drive the engine 30 at a third power ratio or during a generation mode to enable the engine 30 to drive the electric machine 42 at the third power ratio. As shown in FIGS. 12, 14 and 18, the high clutch 440 incudes a generally ring shaped first high annular portion 444 with a high first face 446, a high second face 448, a high inner perimeter 450, and a high outer perimeter 452. The high clutch 440 further includes a second high annular portion 454 spaced from the first high annular portion 444.

The high clutch 440 is secured into position and/or mounted on the sliding shaft 130. In the illustrated example, the first high annular portion 444 circumscribes the sliding shaft 130 and interacts with a collar 168 of the sliding shaft 130. A set of high tabs 456 is positioned on the high outer perimeter 452 and mount or form the actuation pins 320, 442 such that axial movement of the pins 320, 442 with axial movement of the second end 280 of the second linkage 276 functions to axially reposition the first high annular portion 444. The high tabs 456 may be positioned in the one or more second guide slots 166 of the stationary hub 140 and are configured for axial movement in the second guide slots 166 with repositioning of the first high annular portion 444.

The second high annular portion 454 circumscribes the sliding shaft 130 and is rotationally and axially fixed to the sliding shaft 130. In one example, the second high annular portion 454 includes high inner splines 458 configured to engage corresponding outer sliding shaft splines 138. The second high annular portion 454 further includes one or more high clutch engagement elements 460, such as teeth, dogs and the like, configured to selectively engage corresponding elements of the gear set 500 in response to axial repositioning of the high clutch 440 (including the second high annular portion 454) in the second axial direction 82.

The sliding shaft 130 is movable from a retracted position to an extended position relative to the input shaft 128 under a biasing force of the biasing element 136. Conversely, the sliding shaft 130 is movable from the extended position to the retracted position relative to the input shaft 128 against the biasing force of the biasing element 136. The second high annular portion 454 moves with the sliding shaft 130 from the retracted position to the extended position and vice versa.

Accordingly, the second actuator device 270 is energized to effect movement of the first high annular portion 444 in the first axial direction 80 via the armature 272, the second linkage 276 and the second actuation pin 320. The first high annular portion 444 interacts with the collar 168 to move the sliding shaft 130 in the first axial direction 80 against the biasing force of the biasing element 136. In this manner, the sliding shaft 130 is moved to the retracted position relative to the input shaft 128 to reposition the second high annular portion 454 in the first axial direction 80 and disengage the high clutch engagement elements 460 from the corresponding elements of the gear set 500.

The second actuator device 270 may remain energized to hold the sliding shaft 130 (via interaction between the collar 168 and the first high annular portion 444) in the retracted position against the biasing force of the biasing element 136.

Conversely, the second actuator device 270 is deenergized to effect movement (repositioning) of the high clutch 440 in the second axial direction 82 under the return force of the second linkage 276 as well as the biasing force of the biasing element 136. The first high annular portion 444 is moved in the second axial direction 82 under the resilient return force of the second linkage 276 which in turn allows movement of the sliding shaft 130 to the extended position under the biasing force of the biasing element 136. The second high annular portion 454 moves with the sliding shaft 130 in the second axial direction 82. In this manner, the high clutch engagement elements 460 are moved into engagement with the corresponding elements of the gear set 500. Thus, in this example, the second actuator 270 is energized to disengage the high clutch 440 from the gear set 500 and deenergized to engage the high clutch 440 with the gear set 500.

The arrangement of the second linkage assembly 274 enables the second actuator device 270 to operate in a more compact and efficient manner.

Referring now to the cross-sectional view of FIG. 17 and the exploded view of FIG. 19, the gear set 500 of the power transmission assembly 40 is configured to transfer power between the pulley 60 and the fifth housing element 110, which functions as a drive plate. The gear set 500, in this example, is a two-stage planetary gear set that includes a first-stage planetary gear set 510 having a first-stage sun gear 512 mounted for rotation with the sliding shaft 130. The first-stage sun gear 512 includes a plurality of teeth or splines that mesh with a set of first-stage planet gears 514 circumscribing the first-stage sun gear 512. In one example, the first-stage planet gears 514 include two circumferential rows of one or more planet gears, although other embodiments may include a single row or more than two radially stacked rows.

The first-stage planet gears 514 are supported by a first-stage planet carrier 516, which circumscribes the sliding shaft 130 and is at least partially formed by first and second radially extending, axially facing carrier plates. The first-stage carrier plates of the first-stage planet carrier 516 include two rows of mounting locations for receiving axles extending through and supporting the first-stage planet gears 514 for rotation. As such, in this arrangement, each of the planet axles respectively forms an individual axis of rotation for each of the first-stage planet gears 514, and the first-stage planet carrier 516 enables the set of first-stage planet gears 514 to collectively rotate about the first-stage sun gear 512.

The first-stage planetary gear set 510 further includes a ring gear 518 that circumscribes the first-stage planet gears 514. The ring gear 518 includes radially interior teeth that engage the teeth of the first-stage planet gears 514. As such, first-stage planet gears 514 extend between, and engage with, the first-stage sun gear 512 and the ring gear 518.

In one example, the fourth housing element 108 may function as an annular gear housing. The fourth housing element 108 is configured for rotation with, or alternatively, is implemented as part of, the ring gear 518. Accordingly, with respect to the first-stage planetary gear set 510, the fourth housing element 108 (or ring gear 518) may function as the power transfer element 54 relative to the engine 30. The fourth housing element 108 includes a number of castellations 520 that extend axially about the circumference of the axial face that faces the engine 30. The castellations 520 engage and rotatably fix the ring gear 518 to the crank shaft 46 of the engine 30, for example, via the fifth housing element 110, such that the fifth housing element 110 may operate as the drive plate. The fifth housing element 110 may also operate as part of the gear set 500, for example, as a ring gear cover. The ring gear 518 and/or rotatable fourth housing element 108 may be considered as output and/or input elements of the power transmission assembly 40 to receive rotational input in both power flow directions (i.e., to the engine 30 and from the engine 30).

The gear set 500 further includes a second-stage planetary gear set 522 having a second-stage sun gear 524 circumscribing the sliding shaft 130. The first-stage planet carrier 516 circumscribes the second-stage sun gear 524 and has a splined engagement with, or is otherwise rotationally fixed to, the second-stage sun gear 524. Additionally, the second-stage sun gear 524 has a splined engagement with a set of second-stage planet gears 526. The second-stage planet gears 526 are supported by a second-stage planet carrier 528 formed by first and second planet carrier plates. The second-stage planet gears 526 are positioned to additionally engage with the ring gear 518. The second-stage planet gears 526 each have an axle that extends between the two carrier plates that enable each second-stage planet gear 526 to rotate relative to the second-stage planet carrier 528 about the respective axle. As such, the second-stage planet gears 526 are positioned between, and engage with, the second-stage sun gear 524 and the ring gear 518.

Figures 19A, 19B:
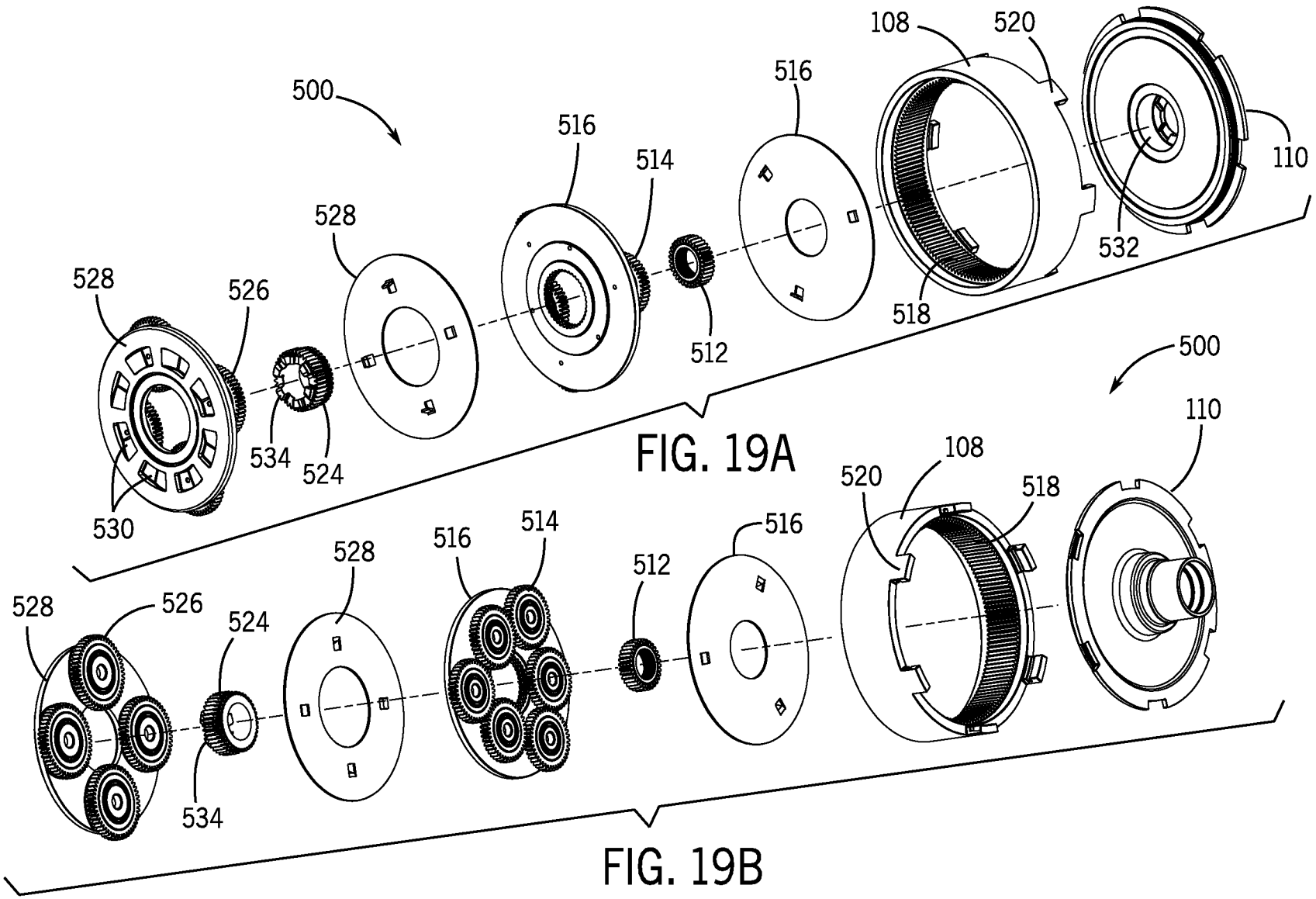
FIGS. 19A and 19B are exploded views of a gear set of the power transmission assembly of FIG. 4 for the example starter-generator device.

The planetary gear set 500 includes one or more portions or elements configured for selective engagement with and disengagement from the low clutch 410, the high clutch 440 and the mid clutch 470. As shown in FIGS. 19A and 19B, the second-stage planet carrier 528 includes one or more low gear engagement elements 530 configured for selective engagement with an disengagement from the corresponding low clutch engagement elements 428. In addition, the fifth housing element 110 (i.e., the ring gear cover and/or drive plate) includes one or more high gear engagement elements 532 configured for selective engagement with and disengagement from the corresponding high clutch engagement elements 460. Further, the second-stage sun gear 524 includes one or more mid gear engagement elements 534 configured for selective engagement with and disengagement from the corresponding mid clutch engagement elements 488. Generally, the various gear engagement elements 530, 532, 534 are configured as slots, locks, slides, sleeves, pockets or recesses that selectively interact with the corresponding clutch engagement elements 428, 460, 488.

The low clutch 410 is repositioned in the second axial direction 82 to engage the second-stage planet carrier 528 in response to the first actuator device 210 being energized, via the first armature 212, the first linkage 216 and the first actuation pin 260. The low clutch 410 is rotationally fixed to the stationary hub 140, which is rotationally fixed to a reaction member, such as the second housing element 104. Thus, the low clutch 410 rotationally fixes, i.e., grounds, the second-stage planet carrier 528 when moved into engagement with the second-stage planet carrier 528.

Figure 20:
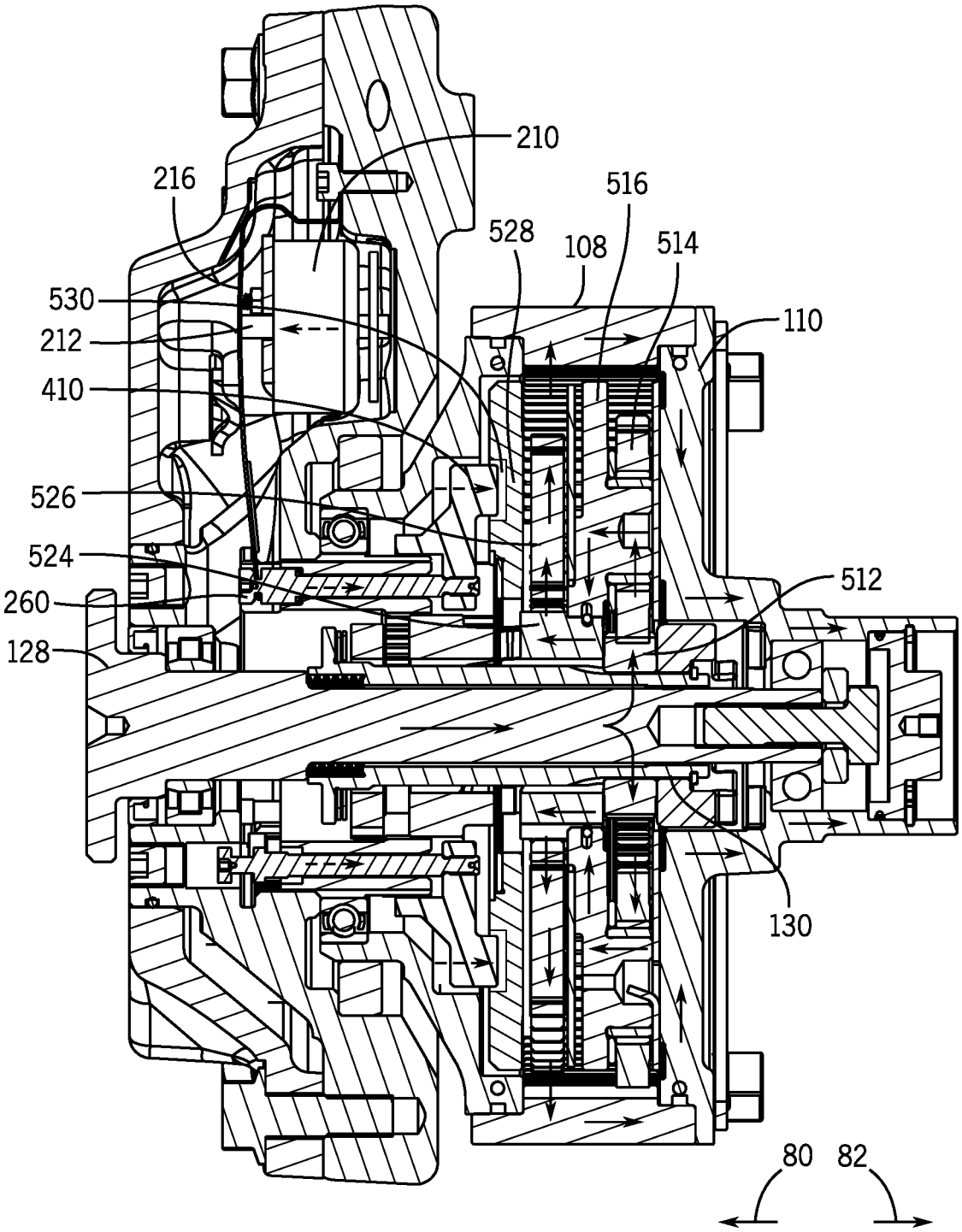
FIG. 20 is a cross-sectional view depicting engagement of a first clutch of the power transmission assembly of FIG. for the example starter-generator device.

Referring to the cross-section shown in FIG. 20, in which the low clutch 410 is engaged with the second-stage planet carrier 528, the power transmission assembly 40 operates in the cold engine start mode, i.e., the low mode. Initially in the cold engine start mode, the engine 30 may be inactive, and activation of the ignition by an operator in the cabin 28 of the work vehicle 20 energizes the electric machine 42 to operate as a motor. Referring to FIG. 3, the electric machine 42 rotates the pulley 62 in the first clock direction D1, thereby driving the belt 64 and pulley 60 in the first clock direction D1. The pulley 60 drives the input shaft 128 and in turn, the sliding shaft 130 and the first-stage sun gear 512, in the first clock direction D1. Rotation of the first-stage sun gear 512 is transmitted through the first and second rows of first-stage planet gears 514 to the first-stage planet carrier 516 causing the first-stage planet carrier 516 and the second-stage sun gear 524 (fixed to the first-stage planet carrier 516) to rotate in the second clock direction D2. Rotation of the second-stage sun gear 524 is transmitted to the second-stage planet gears 526. Because the second-stage planet carrier 528 is grounded via engagement with the low clutch 410, rotation of the second-stage planet gears 526 is transmitted to the ring gear 518 and drives the ring gear 518 and the fourth housing element 108 to rotate in the first clock direction D1.

The ring gear 518 and/or the fourth housing element 108 function as part of the power transfer element 54 to interface with the drive plate 110 (i.e., the fifth housing element 110) mounted to the engine 30 to drive and facilitate engine start. In effect, during the cold engine start mode, the power transmission assembly 40 operates as a sun-in, ring-out configuration. To transition into another mode, the first actuator device 210 in this example is deenergized and the low clutch 410 is moved in the first axial direction 80 to disengage from the second-stage planet carrier 528.

In one example, the power transmission assembly 40 provides a 15:1 gear ratio in the power flow direction of the cold engine start mode. In other embodiments, other gear ratios (e.g., 10:1-30:1) may be provided. Considering a 4:1 gear ratio from the power transfer belt arrangement 50, a resulting 60:1 gear ratio (e.g., approximately 40:1 to about 120:1) may be achieved for the starter-generator device 32 between the electric machine 42 and the engine 30 during the cold engine start mode. As such, if for example the electric machine 42 is rotating at 10,000 RPM, the drive plate 90 mounted to the engine 30 rotates at about 100-150 RPM. In one example, the power transmission assembly 40 may deliver a torque of approximately 3000 Nm to the engine 30. Accordingly, the electric machine 42 may thus have normal operating speeds with relatively lower speed and higher torque output for cold engine start up.

The mid clutch 470 is repositioned to engage the second-stage sun gear 524 in response to the third actuator device 330 being energized. The mid clutch 470 is rotationally fixed to the stationary hub 140, which is rotationally fixed to a reaction member, such as the second housing element 104. Thus, the mid clutch 470 rotationally fixes, i.e., grounds, the second-stage sun gear 524, as well as the first-stage planet carrier 516 fixed to the second-stage sun gear 524, when moved into engagement with the second-stage sun gear 524.

Figure 21:
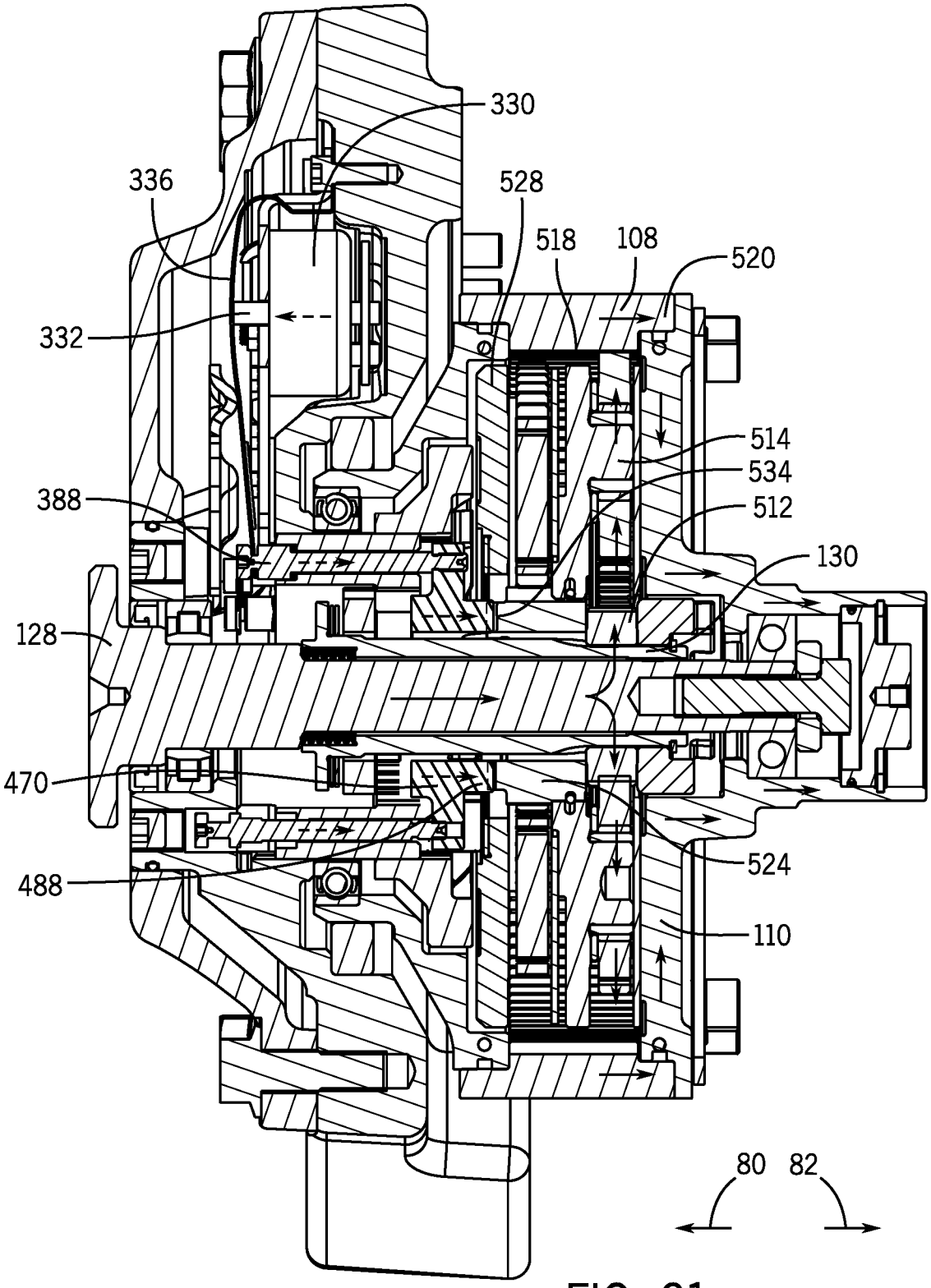
FIG. 21 is a cross-sectional view depicting engagement of a third clutch of the power transmission assembly of FIG. 4 for the example starter-generator device.

Referring to the cross-section shown in FIG. 21, in which the mid-clutch 470 is engaged with the second-stage sun gear 524, the power transmission assembly 40 operates in a warm engine start mode, i.e., the mid mode. Initially in the warm engine start mode, the engine 30 may be inactive, and the controller 36 energizes the electric machine 42 to operate as a motor. Referring to FIG. 3, the electric machine 42 rotates the pulley 62 in the first clock direction D1, thereby driving the belt 64 and the pulley 60 in the first clock direction D1. The pulley 60 drives the input shaft 128 in the first clock direction D1 and in turn, the sliding shaft 130 and the first-stage sun gear 512, in the first clock direction D1. With the first-stage planet carrier 516 grounded, rotation of the first-stage sun gear 512 is transmitted through the first and second rows of first-stage planet gears 514 to the ring gear 518, causing the ring gear 518 and the fourth housing element 108 to rotate in the first clock direction D1.

The ring gear 518 and/or the fourth housing element 108 function as part of the power transfer element 54 to interface with the drive plate 110 (i.e., the fifth housing element 110) mounted to the engine 30 to drive and facilitate engine start. In effect, during the warm engine start mode, the power transmission assembly 40 operates as a sun-in, ring-out configuration, albeit at a lower gear ratio as compared to the cold engine start mode. To transition into another mode, the third actuator device 330 in this example is deenergized and the mid clutch 470 is moved in the first axial direction 80 to disengage from the second-stage sun gear 524.

In one example, the power transmission assembly 40 provides a 4:1 gear ratio in the power flow direction of the warm engine start mode. In other embodiments, other gear ratios (e.g., 3:1-7:1) may be provided. Considering a 4:1 gear ratio from the power transfer belt arrangement 50, a resulting 16:1 gear ratio (e.g., approximately 12:1 to about 28:1) may be achieved for the starter-generator device 32 between the electric machine 42 and the engine 30 during the warm engine start mode. As such, if for example the electric machine 42 is rotating at 10,000 RPM, the drive plate 90 mounted to the engine 30 rotates at about 600-700 RPM. In one example, the torque output of the power transmission assembly 40 for the engine 30 is approximately 400-600 Nm. Accordingly, the electric machine 42 may thus have normal operating speeds with a relatively lower speed and higher torque output for engine start up.

The high clutch 440, including first and second high annular portions 444, 454, is repositioned to engage the fifth housing element 110 (which also functions as the drive plate and a ring gear cover) in response to the second actuator device 270 being deenergized. The high clutch 440, at the second high annular portion 454, is rotationally fixed to the sliding shaft 130 and in turn, the input shaft 128. Thus, the second high annular portion 454 rotates together with the sliding shaft 130 and the input shaft 128.

Figure 22:
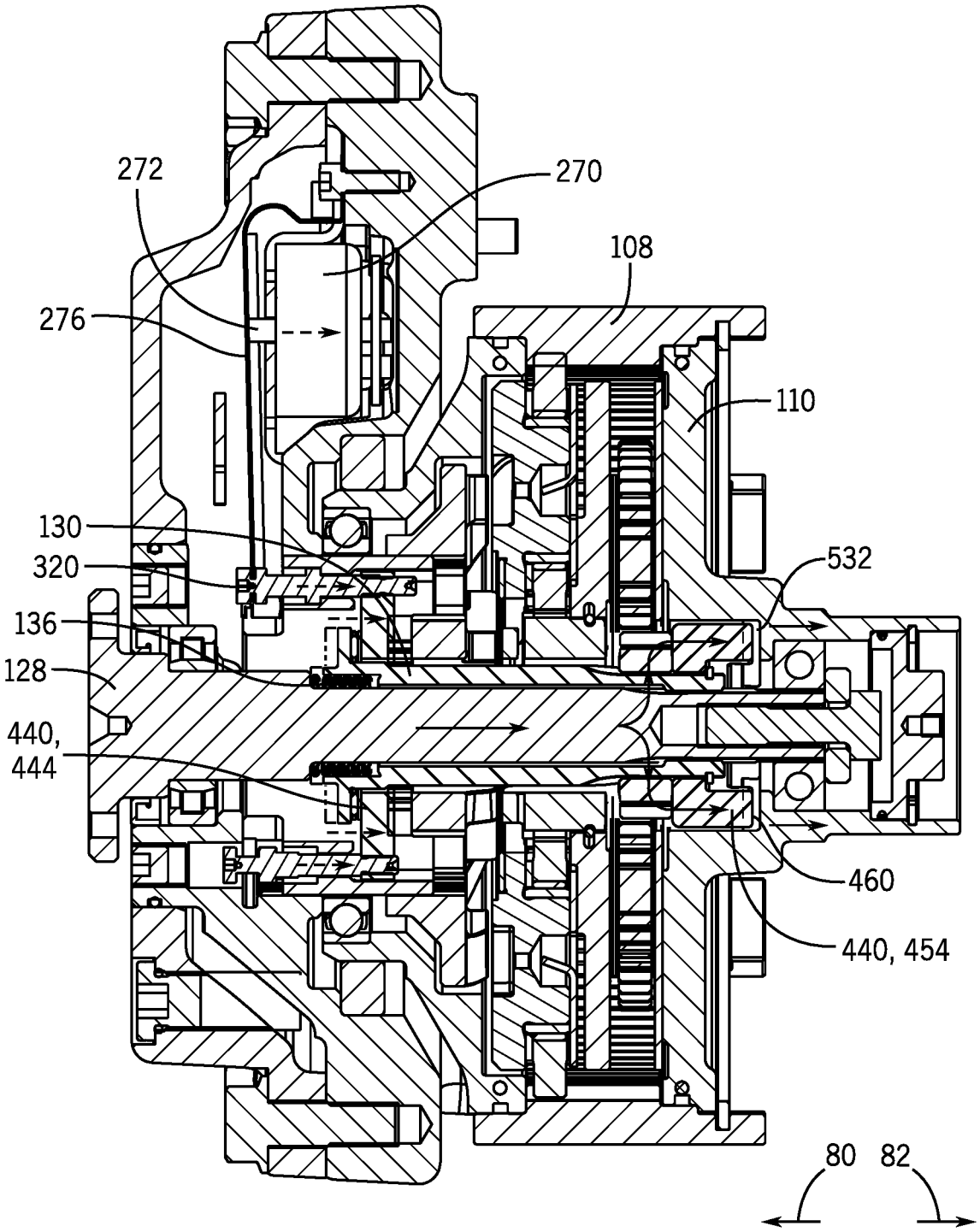
FIG. 22 is a cross-sectional view depicting engagement of a second clutch of the power transmission assembly of FIG. 4 for the example starter-generator device.

Referring to the cross-section shown in FIG. 22, in which the high clutch 440 is engaged with the fifth housing element 110, the power transmission assembly 40 operates in the boost mode, i.e., the high mode. In the boost mode, the engine 30 is active and the electric machine 42 operates as a motor. Referring to FIG. 3, the electric machine 42 rotates the pulley 62 in the first clock direction D1, thereby driving the belt 64 and the pulley 60 in the first clock direction D1. The pulley 60 drives the input shaft 128 and in turn, the sliding shaft 130 and the first-stage sun gear 512 in the first clock direction D1. Rotation of the first-stage sun gear 512 causes rotation of the first-stage planet gears 514.

The input shaft 128 is locked to the ring gear 518 by the high clutch 440 (via the sliding shaft 130, the second high annular portion 454, the fifth housing element 110 and the fourth housing element 108). As a result, rotation of the input shaft 128 drives the ring gear 518, as well as the first-stage sun gear 512, the first-stage planet gears 514, the first-stage planet carrier 516, the second-stage sun gear 524, the second-stage planet gears 526, and the second-stage planet carrier 528 about the primary rotational axis 66, i.e., the drive axis at the same rotational speed as the input shaft 128. In effect, the gear set 500 rotates as a unit about the primary rotational axis 66 in the first clock direction D1. Since other components of the planetary gear set 500 rotate with the input shaft 128 and the sliding shaft 130, the ring gear 518 is driven in the same first clock direction D1. The ring gear 518 and fourth housing element 108 function as part of the power transfer element 54 to interface with the drive plate 110 (i.e., the fifth housing element 110 or ring gear cover) mounted to the engine 30. In effect, during boost mode, the power transmission assembly 40 operates as a sun-in, ring-out configuration.

With the low clutch 410 in the disengaged position, the second-stage planet carrier 528 is not locked to any stationary housing portion (e.g., the second housing element 104), and with the mid clutch 470 in the disengaged position, the first-stage planet carrier 516 is not locked to any stationary housing portion (e.g., the second housing element 104). In this arrangement, the power transmission assembly 40 is configured to operate in the boost mode or the generation mode. In order to transition into another mode, the second actuator device 270 is disengaged (i.e., energized, in this example) and the high clutch 440 may be moved back into the disengaged position such that the second high annular portion 454 disengages the fifth housing element 110.

In one example, the power transmission assembly 40 provides a 1:1 gear ratio in the power flow direction of the boost mode. Thus, the boost mode may be considered a direct drive mode. In other embodiments, other gear ratios may be provided. Considering a 4:1 gear ratio from the power transfer belt arrangement 50, a resulting 4:1 gear ratio may be achieved for the starter-generator device 32 between the electric machine 42 and the engine 30 during the boost mode. As such, if for example the electric machine 42 is rotating at 10,000 RPM, the drive plate 90 mounted to the engine 30 rotates at about 2500 RPM. Accordingly, the electric machine 42 may thus have normal operating speeds while providing an appropriate boost speed to the engine 30.

The power transmission assembly 40 has the same configuration to provide a generation mode as in the boost mode. However, in the generation mode, the engine 30 drives the power transmission assembly 40 and thus the electric machine 42. For the generation mode (and subsequent to the engine start modes and/or the boost mode), the engine 30 begins to accelerate above a rotational speed provided by the power transmission assembly 40, and the electric machine 42 is commanded to decelerate and to cease providing torque to power transmission assembly 40. After the engine 30 has stabilized to a sufficient speed and the electric machine 42 has sufficiently decelerated or stopped, the high clutch 440 is engaged as described above to operate the power transmission assembly 40 in the generation mode.

In the generation mode, the engine 30 rotates the drive plate 110 (i.e., the fifth housing element 110), which in turn rotates the fourth housing element 108 and/or the ring gear 518 in the second clock direction D2. The ring gear 518 drives the first-stage planet gears 514 and the second-stage planet gears 526, which respectively drive the first-stage sun gear 512 and the second-stage sun gear 524, and further drives the sliding shaft 130 and the input shaft 128. Therefore, as the ring gear 518 rotates in the second clock direction D2, the input shaft 128 and the sliding shaft 130 are driven and similarly rotate in the second clock direction D2 at the same rate of rotation. The input shaft 128 is connected with and provides output power to the electric machine 42 in the second clock direction D2 via the power transfer belt arrangement 50. In effect, during the generation mode, the power transmission assembly 40 operates as a ring-in, sun-out configuration.

In one example, the power transmission assembly 40 provides a 1:1 gear ratio in the power flow direction of the generation mode. In other embodiments, other gear ratios may be provided. Considering a 4:1 gear ratio from the power transfer belt arrangement 50, a resulting 4:1 gear ratio may be achieved for the starter-generator device 32 between the electric machine 42 and the engine 30 during the generation mode. As a result, the electric machine 42 may thus have normal operating speeds in both power flow directions with relatively low toque output during power generation.

Thus, various embodiments of the vehicle electric system have been described that include an integrated starter-generator device. The combination starter-generator may include a clutch arrangement with first, second, and third clutches (i.e., low, high and mid clutches) that are actuated with actuator devices such as electromechanical solenoid devices mounted on an actuation assembly. In this manner, the clutches are axially repositioned relative to the gear set to axially shift between engaged and disengaged positions, thereby modifying the power flow within the power transmission assembly. The clutch arrangements may be configured to engage or disengage via movement in either axial direction as desired. Additional actuator devices may be provided to engage and move the additional actuation pins of the clutches. As a result of the unidirectional actuator devices mounted on one side, the part costs and assembly time are reduced and potential assembly errors are mitigated. The unitary construction of the fulcrums, linkages, and/or the actuation pins further simplify manufacturing and assembly. The use of the unidirectional electromechanical solenoid devices to reposition the locking dog clutches provides a compact transmission and starter-generator assembly that may not require high pressure electro-hydraulic solenoids, while enabling improved packaging, wire routing, and package size. Moreover, the linkages of the present embodiments may facilitate relatively quick and easy installation because the linkages are not pretensioned during installation. Instead, the linkages are formed having a neck region with a permanent bend extending in axial and radial directions to accommodate deflection (elastic deformation) of the linkage to a loaded condition and resilient biasing of the linkage to return to an undeformed, unloaded condition.

Various transmission assemblies may be included in the device, thus reducing the space occupied by the system. The transmission assembly may provide multiple speeds or gear ratios and transition between speeds/gear ratios. One or more clutch arrangements may be used to selectively apply torque to the gear set of the transmission assembly in both power flow directions. Direct mechanical engagement with the engine shaft reduces the complexity and improves reliability of the system. Using planetary gear sets in the transmission assembly provides high gear reduction and torque capabilities with reduced backlash in a compact space envelope. As a result of the bi-directional nature of the power transmission assembly, the power transfer belt arrangement may be implemented with only a single belt tensioner, thereby providing a relatively compact and simple assembly. Additionally, by using the power transfer belt arrangement with belt and pullies to couple together and transfer power between the electric machine and the power transmission assembly, instead of directly connecting and coupling the electric machine to the power transmission assembly, the electric machine may be mounted apart from the transmission assembly to better fit the engine in a vehicle engine bay. Additionally, by using the belt and pullies to couple the electric machine to the power transmission assembly, an additional gear ratio (e.g., a 4:1 ratio) may be achieved. Embodiments discussed above include a double planetary gear set, sun in, ring out configuration to provide warm and cold engine start modes and a ring in, sun out configuration to provide a generation mode. As such, a four-mode assembly may be provided.

Enumberated Examples of Integrated Starter-Generator Device with Unidirectional Clutch Actuation Utilizing Biased Lever Assembly The following examples of integrated starter-generator devices with unidirectional clutch actuation are further provided and numbered for ease of reference.

1. A combination starter-generator device for a work vehicle having an engine, the starter-generator device including a housing arrangement having one or more housing elements forming a stationary reaction member and a gear set configured to transmit power flow to and from the engine. The device also includes a clutch arrangement having one or more portions configured to selectively interact with the gear set to modify power flow through the gear set, an actuator device having an armature, the actuator device operable to power movement of the armature in a first axial direction to apply a push force, and a linkage coupled between the actuator device and a portion of the clutch arrangement. The linkage has a first end proximal to the reaction member, a first portion extending from the first end, and a second portion extending radially from the first portion to a second end. The first portion has a neck region formed as a permanent bend having a bend radius and the second portion has a coupling region configured to interact with the armature, a stiffened region, and a connection region at the second end. The device further includes an actuation pin connected to the connection region and the portion of the clutch arrangement. The linkage is formed from a flexible resilient material and is movable in a powered stroke from an undeformed, unloaded condition to an elastically deformed, loaded condition by application of the push force, and is movable in a return stroke from the elastically deformed, loaded condition to the undeformed, unloaded condition under an elastic return force with the push force removed. The second end is displaced in one of the first axial direction and a second axial direction in the powered stroke to reposition the portion of the clutch arrangement in the same one of the first axial direction and the second axial direction. The second end is moved in the other of the first axial direction and the second axial direction in the return stroke to reposition the portion of the clutch arrangement in the same other of the first axial direction and the second axial direction.

2. The combination starter-generator device of example 1, wherein the actuator device is energized to apply the push force and is deenergized to remove the push force.

3. The combination starter-generator device of example 1, wherein the stiffened region includes one or more flanges.

4. The combination starter-generator device of example 3, wherein the stiffened region includes at least two flanges forming a channel along at least a portion of a length of the second portion.

5. The combination starter-generator device of example 1, wherein the push force elastically deforms the neck region and deflects the second portion in the first axial direction to displace the second end in the first axial direction, such that the actuation pin is moved in the first axial direction with the second end to reposition the portion of the clutch arrangement in the first axial direction.

6. The combination starter-generator device of example 5, wherein under the elastic return force, the neck region returns to an undeformed condition to move the second portion and the second end in the second axial direction, such that the coupling region moves the armature in the second axial direction and the actuation pin is moved in the second axial direction with the second end to reposition the portion of the clutch arrangement in the second axial direction.

7. The combination starter-generator device of example 6, wherein the portion of the clutch arrangement is repositioned in the first axial direction to disengage a corresponding portion of the gear set and is repositioned in the second axial direction to engage the corresponding portion of the gear set.

8. The combination start-generator device of example 5, wherein the coupling region is arranged at a position along the stiffened region.

9. The combination starter-generator device of example 1, wherein the second portion further includes a fulcrum region and the housing arrangement further includes a fulcrum configured to interact with the fulcrum region, wherein the push force elastically deforms the neck region and deflects the coupling region in the first axial direction to urge the fulcrum region into contact with the fulcrum, and the fulcrum interacts with the fulcrum region to displace the second end in the second axial direction, such that the actuation pin is moved in the second axial direction with the second end to reposition the portion of the clutch arrangement in the second axial direction.

10. The combination starter-generator device of example 9, wherein under the elastic return force, the neck region returns to an undeformed condition to move the coupling region in the second axial direction, the fulcrum region away from the fulcrum, and the second end in the first axial direction, such that the actuation pin is moved in the first axial direction with the second end to reposition the portion of the clutch arrangement in the first axial direction.

11. The combination starter-generator device of example 10, wherein the portion of the clutch arrangement is repositioned in the second axial direction to engage a corresponding portion of the gear set and is repositioned in the first axial direction to disengage the corresponding portion of the gear set.

12. The combination starter-generator device of example 9, wherein the coupling region is spaced from the stiffened region along a length of the second portion, and the fulcrum region is arranged between the coupling region and the stiffened region.

13. The combination starter-generator device of example 1, wherein the first portion further includes a mounting region configured to receive a fastener for securing the linkage to the reaction member, wherein the mounting region has a first width and the neck region has a second width less than the first width.

14. The combination starter-generator device of example 13, wherein the second portion has a third width greater than the second width of the neck region.

15. The combination starter-generator device of example 1, wherein the linkage is installed in the undeformed, unloaded condition and is not pretensioned for installation.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A combination starter-generator device for a work vehicle having an engine, the combination starter-generator device comprising:

a housing arrangement forming a reaction member;

a gear set configured to transmit power flow to and from the engine;

a clutch arrangement configured to selectively interact with the gear set to modify power flow through the gear set;

an actuator device having an armature, the actuator device operable to power movement of the armature in a first axial direction to apply a push force;

a linkage coupled between the actuator device and a portion of the clutch arrangement, the linkage having a first end proximal to the reaction member, a first portion extending from the first end, and a second portion extending radially from the first portion to a second end, the first portion having a neck region formed as a permanent bend having a bend radius, and the second portion having a coupling region configured to interact with the armature, a stiffened region, and a connection region at the second end, wherein the stiffened region includes one or more flanges; and an actuation pin connected to the connection region and the portion of the clutch arrangement, wherein the linkage is formed from a flexible resilient material and is movable in a powered stroke from an undeformed, unloaded condition to an elastically deformed, loaded condition by application of the push force, and is movable in a return stroke from the elastically deformed, loaded condition to the undeformed, unloaded condition under an elastic return force with the push force removed, wherein the second end is displaced in the first axial direction or a second axial direction in the powered stroke to reposition the portion of the clutch arrangement in the same one of the first axial direction or the second axial direction, and wherein the second end is moved in the other of the first axial direction or the second axial direction in the return stroke to reposition the portion of the clutch arrangement in the same other of the first axial direction or the second axial direction.

2. The combination starter-generator device of claim 1, wherein the actuator device is energized to apply the push force and is deenergized to remove the push force.

3. The combination starter-generator device of claim 1, wherein the stiffened region includes at least two flanges forming a channel along at least a portion of a length of the second portion.

4. The combination starter-generator device of claim 1, wherein the push force elastically deforms the neck region and deflects the second portion in the first axial direction to displace the second end in the first axial direction, such that the actuation pin is moved in the first axial direction with the second end to reposition the portion of the clutch arrangement in the first axial direction.

5. The combination starter-generator device of claim 4, wherein under the elastic return force, the neck region returns to an undeformed condition to move the second portion and the second end in the second axial direction, such that the coupling region moves the armature in the second axial direction and the actuation pin is moved in the second axial direction with the second end to reposition the portion of the clutch arrangement in the second axial direction.

6. The combination starter-generator device of claim 5, wherein the portion of the clutch arrangement is repositioned in the first axial direction to disengage a corresponding portion of the gear set and is repositioned in the second axial direction to engage the corresponding portion of the gear set.

7. The combination starter-generator device of claim 4, wherein the coupling region is arranged at a position along the stiffened region.

8. The combination starter-generator device of claim 1, wherein the second portion further includes a fulcrum region and the housing arrangement further includes a fulcrum configured to interact with the fulcrum region, wherein the push force elastically deforms the neck region and deflects the coupling region in the first axial direction to urge the fulcrum region into contact with the fulcrum, and the fulcrum interacts with the fulcrum region to displace the second end in the second axial direction, such that the actuation pin is moved in the second axial direction with the second end to reposition the portion of the clutch arrangement in the second axial direction.

9. The combination starter-generator device of claim 8, wherein under the elastic return force, the neck region returns to an undeformed condition to move the coupling region in the second axial direction, the fulcrum region away from the fulcrum, and the second end in the first axial direction, such that the actuation pin is moved in the first axial direction with the second end to reposition the portion of the clutch arrangement in the first axial direction.

10. The combination starter-generator device of claim 9, wherein the portion of the clutch arrangement is repositioned in the second axial direction to engage a corresponding portion of the gear set and is repositioned in the first axial direction to disengage the corresponding portion of the gear set.

11. The combination starter-generator device of claim 8, wherein the coupling region is spaced from the stiffened region along a length of the second portion, and the fulcrum region is arranged between the coupling region and the stiffened region.

12. The combination starter-generator device of claim 1, wherein the linkage is installed in the undeformed, unloaded condition and is not pretensioned for installation.

13. A combination starter-generator device for a work vehicle having an engine, the combination starter-generator device comprising:

a housing arrangement forming a reaction member;

a gear set configured to transmit power flow to and from the engine;

a clutch arrangement configured to selectively interact with the gear set to modify power flow through the gear set;

an actuator device having an armature, the actuator device operable to power movement of the armature in a first axial direction to apply a push force;

a linkage coupled between the actuator device and a portion of the clutch arrangement, the linkage having a first end proximal to the reaction member, a first portion extending from the first end, and a second portion extending radially from the first portion to a second end, the first portion having a neck region formed as a permanent bend having a bend radius, and the second portion having a coupling region configured to interact with the armature, a stiffened region, and a connection region at the second end; and an actuation pin connected to the connection region and the portion of the clutch arrangement, wherein the linkage is formed from a flexible resilient material and is movable in a powered stroke from an undeformed, unloaded condition to an elastically deformed, loaded condition by application of the push force, and is movable in a return stroke from the elastically deformed, loaded condition to the undeformed, unloaded condition under an elastic return force with the push force removed, wherein the second end is displaced in the first axial direction or a second axial direction in the powered stroke to reposition the portion of the clutch arrangement in the same one of the first axial direction or the second axial direction, wherein the second end is moved in the other of the first axial direction or the second axial direction in the return stroke to reposition the portion of the clutch arrangement in the same other of the first axial direction or the second axial direction, and wherein the first portion further includes a mounting region configured to receive a fastener for securing the linkage to the reaction member, wherein the mounting region has a first width and the neck region has a second width less than the first width.

14. The combination starter-generator device of claim 13, wherein the second portion has a third width greater than the second width of the neck region.

15. A combination starter-generator device for a work vehicle having an engine, the combination starter-generator device comprising:

a housing arrangement forming a reaction member;

an input shaft extending within the housing arrangement, the input shaft rotatable on a drive axis;

a sliding shaft rotationally fixed to the input shaft and axially slidable relative to the input shaft;

a gear set configured to transmit power flow to and from the engine, wherein the gear set interfaces with the sliding shaft for rotation;

a first clutch shiftable into a disengaged position in which the first clutch is decoupled from the gear set and into an engaged position in which the first clutch is coupled to the gear set to effect a first gear ratio;

a first actuator device having a first armature, wherein the first actuator device is energized to power movement of the first armature to apply a first push force in a first axial direction and is deenergized to remove the first push force;

a first linkage having a first portion secured to the reaction member and extending axially away from the reaction member, and a second portion extending radially inward from the first portion of the first linkage to a first distal end, the first portion of the first linkage including a first neck region formed as a permanent bend having a first bend radius and a reduced width relative to the second portion of the first linkage, wherein the first distal end is movable in a second axial direction in response to the first push force applied to the second portion of the first linkage to move the first linkage from an undeformed, unloaded condition to an elastically deformed, loaded condition, and wherein the first distal end is movable in the first axial direction under an elastic return force of the first linkage in response to removal of the first push force from the second portion of the first linkage, to move the first linkage from the elastically deformed, loaded condition to the undeformed, unloaded condition;

a first actuation pin connected to the first distal end of the first linkage and the first clutch such that movement of the first distal end in the first axial direction or the second axial direction causes movement of the first actuation pin to reposition the first clutch in the same one of the first axial direction or the second axial direction;

a second clutch shiftable into a disengaged position in which the second clutch is decoupled from the gear set and into an engaged position in which the second clutch is coupled to the gear set to effect a second gear ratio higher than the first gear ratio;

a second actuator device having a second armature, wherein the second actuator device is energized to power movement of the second armature to apply a second push force in the first axial direction and is deenergized to remove the second push force;

a second linkage having a first portion secured to the reaction member and extending axially away from the reaction member, and a second portion extending radially inward from the first portion of the second linkage to a second distal end, the first portion of the second linkage including a second neck region formed as a permanent bend having a second bend radius and a reduced width relative to the second portion of the second linkage, wherein the second distal end is movable in the first axial direction in response to the second push force applied to the second portion of the second linkage to move the second linkage from an undeformed, unloaded condition to an elastically deformed, loaded condition, and wherein the second distal end is movable in the second axial direction under an elastic return force of the second linkage in response to removal of the second push force from the second portion of the second linkage to move the second linkage from the elastically deformed, loaded condition to the undeformed, unloaded condition; and a second actuation pin connected to the second distal end of the second linkage and the second clutch such that movement of the second distal end in the first axial direction or the second axial direction causes movement of the second actuation pin to reposition the second clutch in the same one of the first axial direction or the second axial direction.

16. The combination starter-generator device of claim 15, further comprising:

a third clutch shiftable into a disengaged position in which the third clutch is decoupled from the gear set and into an engaged position in which the third clutch is coupled to the gear set to effect a third gear ratio between the first gear ratio and the second gear ratio;

a third actuator device having a third armature, wherein the third actuator device is energized to power movement of the third armature to apply a third push force in the first axial direction;

a third linkage having a first portion secured to the reaction member and extending axially away from the reaction member, and a second portion extending radially inward from the first portion of the third linkage to a third distal end, the first portion of the third linkage including a third neck region formed as a permanent bend having a third bend radius and a reduced width relative to the second portion of the third linkage, wherein the third distal end is movable in the second axial direction in response to the third push force applied to the second portion of the third linkage to move the third linkage from an undeformed, unloaded condition to an elastically deformed, loaded condition, and wherein the third distal end is movable in the first axial direction under an elastic return force of the third linkage in response to removal of the third push force from the second portion of the third linkage to move the third linkage from the elastically deformed, loaded condition to the undeformed, unloaded condition; and a third actuation pin connected to the third distal end of the third linkage and the third clutch such that movement of the third distal end in the first axial direction or the second axial direction causes movement of the third actuation pin to reposition the third clutch in the same one of the first axial direction or the second axial direction.

17. The combination starter-generator device of claim 6, the housing arrangement further comprising a fulcrum bracket arranged opposite to the first linkage and the third linkage, the fulcrum bracket having a first fulcrum and a second fulcrum, wherein the first linkage includes a first fulcrum region on the second portion configured to interact with the first fulcrum, such that movement of the second portion in the first axial direction causes the first fulcrum region to interact with the first fulcrum to move the first distal end in the second axial direction, and wherein the third linkage includes a second fulcrum region on the second portion configured to interact with the second fulcrum, such that movement of the second portion in the first axial direction causes the second fulcrum region to interact with the second fulcrum to move the third distal end in the second axial direction.

18. The combination starter-generator device of claim 16, wherein:

the first linkage further includes a first stiffened region on the second portion and the first armature interacts with the second portion at a first coupling region spaced from the first stiffened region;

the second linkage further includes a second stiffened region on the second portion and the second armature interacts with the second portion at a second coupling region arranged at a position along the second stiffened region; and the third linkage further includes a third stiffened region on the second portion and the third armature interacts with the second portion at a third coupling region spaced from the third stiffened region.

19. The combination starter-generator device of claim 16, wherein the reaction member includes a first recess, a second recess, and a third recess arranged on one side, and the first actuator device, the second actuator device and the third actuator device are mounted in the first recess, the second recess and the third recess, respectively.

* * * * *